US012453426B2

(12) United States Patent
Peterson et al.

(10) Patent No.: US 12,453,426 B2
(45) Date of Patent: Oct. 28, 2025

(54) POCKETED BUCKLING MEMBER ASSEMBLY

(71) Applicant: L&P Property Management Company, South Gate, CA (US)

(72) Inventors: Bruce W. Peterson, Austin, TX (US); Matthew D. McKnight, Fort Smith, AR (US); Takayuki Hironaka, Fort Smith, AR (US)

(73) Assignee: L&P Property Management Company, Carthage, MO (US)

( * ) Notice: Subject to any disclaimer, the term of this patent is extended or adjusted under 35 U.S.C. 154(b) by 82 days.

(21) Appl. No.: 18/586,716

(22) Filed: Feb. 26, 2024

(65) Prior Publication Data

US 2025/0268390 A1 Aug. 28, 2025

(51) Int. Cl.
*A47C 27/06* (2006.01)
*A47C 27/04* (2006.01)

(52) U.S. Cl.
CPC ..... *A47C 27/064* (2013.01); *A47C 27/063* (2013.01); *A47C 27/066* (2013.01); *A47C 27/04* (2013.01); *A47C 27/06* (2013.01)

(58) Field of Classification Search
CPC ... A47C 27/064; A47C 27/063; A47C 27/066; A47C 27/065; A47C 27/06; A47C 27/04
USPC ..... 5/655.8, 655.7, 720, 716, 718, 719
See application file for complete search history.

(56) References Cited

U.S. PATENT DOCUMENTS 6,131,892 A * 10/2000 Stumpf ..... A47C 27/064 267/89
6,490,744 B1 * 12/2002 Schulz, Jr. ..... A47C 27/063 5/716
6,499,275 B1 * 12/2002 Graf ..... B68G 9/00 53/436
6,591,436 B2 * 7/2003 de Santis ..... B68G 9/00 5/655.8
8,895,109 B2 * 11/2014 Blanga Cohen ..... A47C 23/002 267/91
9,060,616 B2 * 6/2015 Cohen ..... A47C 27/056
9,332,856 B2 * 5/2016 Eigenmann ..... A47C 27/064
9,370,252 B2 * 6/2016 Eigenmann ..... A47C 23/043
9,936,815 B2 * 4/2018 DeMoss ..... A47C 27/064
10,010,190 B2 * 7/2018 Eigenmann ..... A47C 21/042
11,229,299 B1 1/2022 Peterson
(Continued)

FOREIGN PATENT DOCUMENTS

WO WO-2020222886 A1 * 11/2020 ..... A47C 27/064

OTHER PUBLICATIONS

Patent Cooperation Treaty, International Searching Authority, International Search Report in regard to International Application No. PCT/US2025/013500, mailed Mar. 20, 2025, 4 pages.

*Primary Examiner* — Robert G Santos
(74) *Attorney, Agent, or Firm* — Wood Herron & Evans LLP

(57) ABSTRACT

A pocketed buckling member assembly comprises a plurality of parallel strings of pocketed buckling members. Each string is joined to at least one adjacent string. Each string comprising one piece of fabric folded around the buckling members into first and second opposed plies. Pockets are formed along each string by transverse seams joining the first and second plies. At least one buckling member is positioned in each pocket. The buckling member may have additives therein.

20 Claims, 24 Drawing Sheets

(56) References Cited

U.S. PATENT DOCUMENTS

| | | | | |
|---|---|---|---|---|
| 2013/0081207 | A1* | 4/2013 | Cohen | A47C 27/062<br>267/143 |
| 2013/0337178 | A1* | 12/2013 | Blanga Cohen | A47C 27/056<br>427/331 |
| 2015/0342362 | A1* | 12/2015 | DeMoss | A47C 27/20<br>5/718 |
| 2015/0359349 | A1* | 12/2015 | Eigenmann | A47C 21/042<br>5/655.8 |
| 2015/0359350 | A1* | 12/2015 | Eigenmann | A47C 27/05<br>5/655.8 |
| 2016/0249744 | A1* | 9/2016 | Eigenmann | A47C 27/064<br>5/655.8 |
| 2017/0258242 | A1 | 9/2017 | Codos | |
| 2021/0298486 | A1* | 9/2021 | Jewett | A47C 27/064 |
| 2022/0338641 | A1 | 10/2022 | Smiderle et al. | |
| 2023/0088072 | A1* | 3/2023 | Stojanovic | A47C 27/001<br>5/665 |
| 2023/0092909 | A1* | 3/2023 | Jewett | A47C 27/064<br>5/720 |

* cited by examiner

POCKETED BUCKLING MEMBER ASSEMBLY

FIELD OF THE INVENTION

This invention relates generally to bedding and seating products and, more particularly, to pocketed buckling member assemblies used in bedding and seating products.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

Improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a pocketed spring core or assembly for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Conventional pocketed spring cores incorporating pocketed strings of springs have less motion transfer between sleeping partners when compared to traditional helically-laced open coil spring assemblies. Each pocketed coil spring moves with greater independence and, therefore provide less influence on adjacent pocketed coil springs than if the coil springs were not inside individual pockets. However, with a traditional pocketed spring mattress, a sheet of foam or other cushioning layer is attached to an upper surface of the pocketed spring assembly. The foam or cushioning sheet or sheets acts like a bridge, such that a load applied to one side of a mattress affects the other side of the mattress, providing an undesirable bridging effect. The present invention eliminates the undesirable bridging effect by encapsulating individual cushion members inside outer pockets of strings of springs.

U.S. Pat. No. 11,229,299 discloses a pocketed spring assembly incorporating strings which have individually pocketed coil springs with a cushioning pad and a buckling member inside the outer pockets. However, due to the inner coil springs being individually pocketed and contained within an outer pocket with a cushioning pad and a buckling member, the manufacture of such a product may be expensive.

Therefore, there remains a need to combine multiple technologies to reduce the manufacturing costs of a bedding or seating product having buckling members inside pockets.

There is further a need for a buckling member having additives to provide desired properties to a pocketed buckling member layer for use in a bedding or seating product.

SUMMARY OF THE INVENTION

In one aspect, a bedding or seating product is provided. The product comprises a pocketed buckling member assembly comprising a plurality of parallel strings of pocketed buckling members, each string being joined to at least one adjacent string. Each string comprises a piece of fabric surrounding a plurality of buckling members, first and second opposed plies of fabric being on opposite sides of the buckling members. A plurality of pockets having the same height are formed along the length of the string by a longitudinal seam and transverse seams joining the first and second plies. A single buckling member is in each of the pockets. Each buckling member has a height approximately equal to the height of the pocket in which the buckling member resides. Each of the buckling members may be a unitary member having an outer wall, a center, and internal ribs extending between the outer wall and center. These buckling members may have an open top and open bottom which define passages between the internal ribs. In some embodiments, each of the buckling members may have at least three internal ribs. The buckling members may have any number of passages of any desired size or shape.

Each of the buckling members is made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

Cushioning materials may be placed on the pocketed buckling member assembly, and a covering, usually an upholstered covering, encases the pocketed buckling member assembly and cushioning materials.

The strings may extend longitudinally (from end-to-end) or transversely (from side-to-side). A pocketed buckling member assembly for use in a bedding or seating product may be posturized into regions or zones of different firmness by incorporating different strings into the pocketed buckling member assembly.

At least some of the buckling members may contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials. Such additives may impart different properties to the buckling members such as firmness, for example. The additives may be in the form of conductive solids, powders, particles or flakes.

At least some of the buckling members may have an outer wall and a hollow interior without any internal ribs or center. These buckling members may have an open top and open bottom which define one passage.

In another aspect, a pocketed buckling member assembly for a bedding or seating product is provided. The pocketed buckling member assembly comprises a plurality of parallel strings of pocketed buckling members. Each string is joined to at least one adjacent string. Each of the strings comprises a plurality of interconnected pockets made from one piece of fabric. Each of the pockets contains one buckling member encased in fabric, the buckling member filling the pocket with nothing else inside the pocket. The piece of fabric is joined to itself along a longitudinal seam and has first and second opposed plies of fabric on opposite sides of the buckling members. The first and second plies of fabric are joined by transverse seams between adjacent buckling members creating individual pockets, each pocket containing a single buckling member. Each of the buckling members is made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

At least some of the buckling members may contain at least one of the following additives: phase change materials, plant-based fibers such as cellulose, cotton, hemp, linen, jute, wool and the like, synthetic fibers including carbon fiber, nylon, olefin, acrylic, polyester, rayon, vinyon, spandex, vinalon, aramids, Modal, PBI, Orlon and the like, fragrances including slow-release fragrances, organic and inorganic antimicrobial additives such as zinc omadine, N-Butyl-1,2-Benzisothiazonlin-3-one, OIT (2-n-Octyl-4-isothiazolin-3-one, 3-(Trimetholyxysily) proplydimethyloctadecyl ammonium chloride, copper and silver and the like, color additives, thermochromic materials, conductive additive solids, powders, particles, flakes such as activated carbon, carbon nanotubes, graphene, graphite, aluminum powder, silicon carbide, diamond dust and the like may be incorporated into the material. Density reducing agents such as fumed silica or gas generating materials may be added too.

In some embodiments, each of the buckling members is a unitary member having an outer wall, internal ribs extending inwardly from the outer wall to a center, an open top and an open bottom defining passages between the internal ribs. In some of these embodiments, the buckling member has at least three internal ribs.

In another aspect, a pocketed buckling member assembly comprises a plurality of parallel strings of pocketed buckling members. Each string is joined to an adjacent string. Each of the strings comprises a plurality of interconnected outer pockets made from one piece of fabric. Each of the pockets is approximately the same height. Each pocket contains a single buckling member having the same height as the pocket. The piece of fabric is joined to itself along a longitudinal seam and has first and second opposed plies of fabric on opposite sides of the buckling members. The fabric of the first and second plies is joined by transverse seams. Some of the strings of pocketed buckling members have buckling members made of a different material than the buckling members of other strings. However, the buckling members within a string are the same or substantially the same. Such a pocketed buckling member assembly may have edge support due to the buckling members of the outermost strings being different than the buckling members of the interior strings.

Each of the buckling members may be a unitary member having a hollow interior and being made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

At least some of the buckling members contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

In any embodiment shown or described herein, at least some of the buckling members may be a unitary member having an outer wall, a center, and internal ribs extending between the outer wall and center. These buckling members may have an open top and open bottom which define passages between the internal ribs. In some embodiments, each of the buckling members may have at least three internal ribs. The buckling members may have any number of passages of any desired size or shape.

One advantage of the present invention is that when a bedding or seating product, such as a mattress, is manufactured, the manufacturer need not purchase metal coil springs, which may be expensive.

Another advantage of the present invention is that the buckling members may be individually pocketed after having been formed with additives. The additives may impart a cooler "feel" to the user of the bedding or seating product in some areas or regions of a bedding or seating product when compared to other areas or regions.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
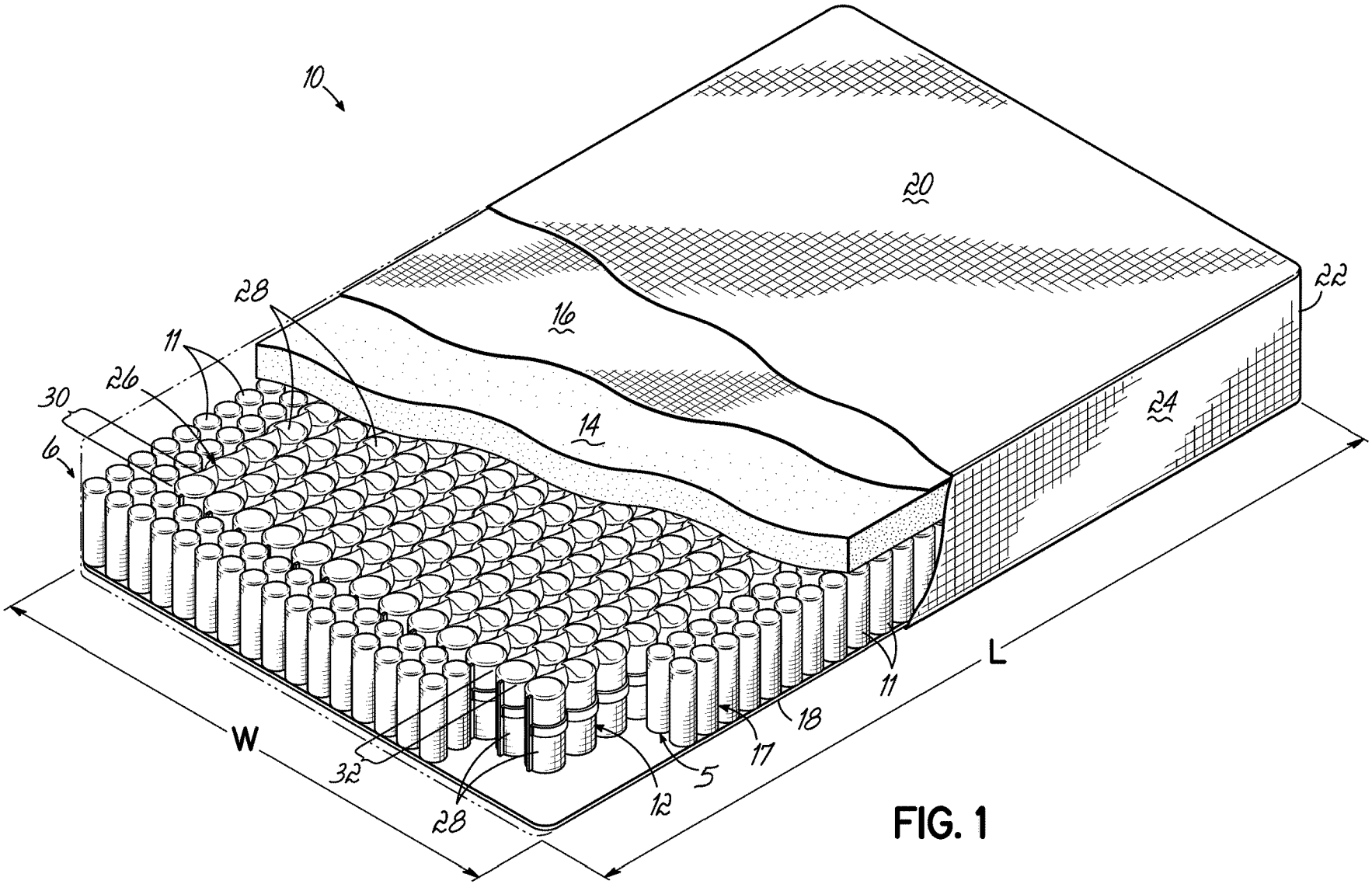
FIG. 1 is a perspective view, partially broken away, of a bedding or seating product incorporating a pocketed buckling member assembly surrounded by a border.

Referring first to FIG. 1, there is illustrated a bedding product in the form of a single-sided mattress 10 incorporating the principles of the present invention. This product or mattress 10 comprises a pocketed buckling member assembly 12 over the top of which there lay conventional padding or cushioning layers 14, 16 which may be foam, fiber, gel, a pocketed spring blanket or any other suitable materials or any combination thereof. The pocketed buckling member assembly 12 is mounted upon a base 18 and is completely enclosed within an upholstered covering 20. The base 18 may be any known material including a flexible sheet such as a scrim sheet or a more rigid dimensionally stabilizing substrate as described in U.S. Pat. No. 11,013,340 or 11,771,235, which are each incorporated by reference herein.

Figure 4:
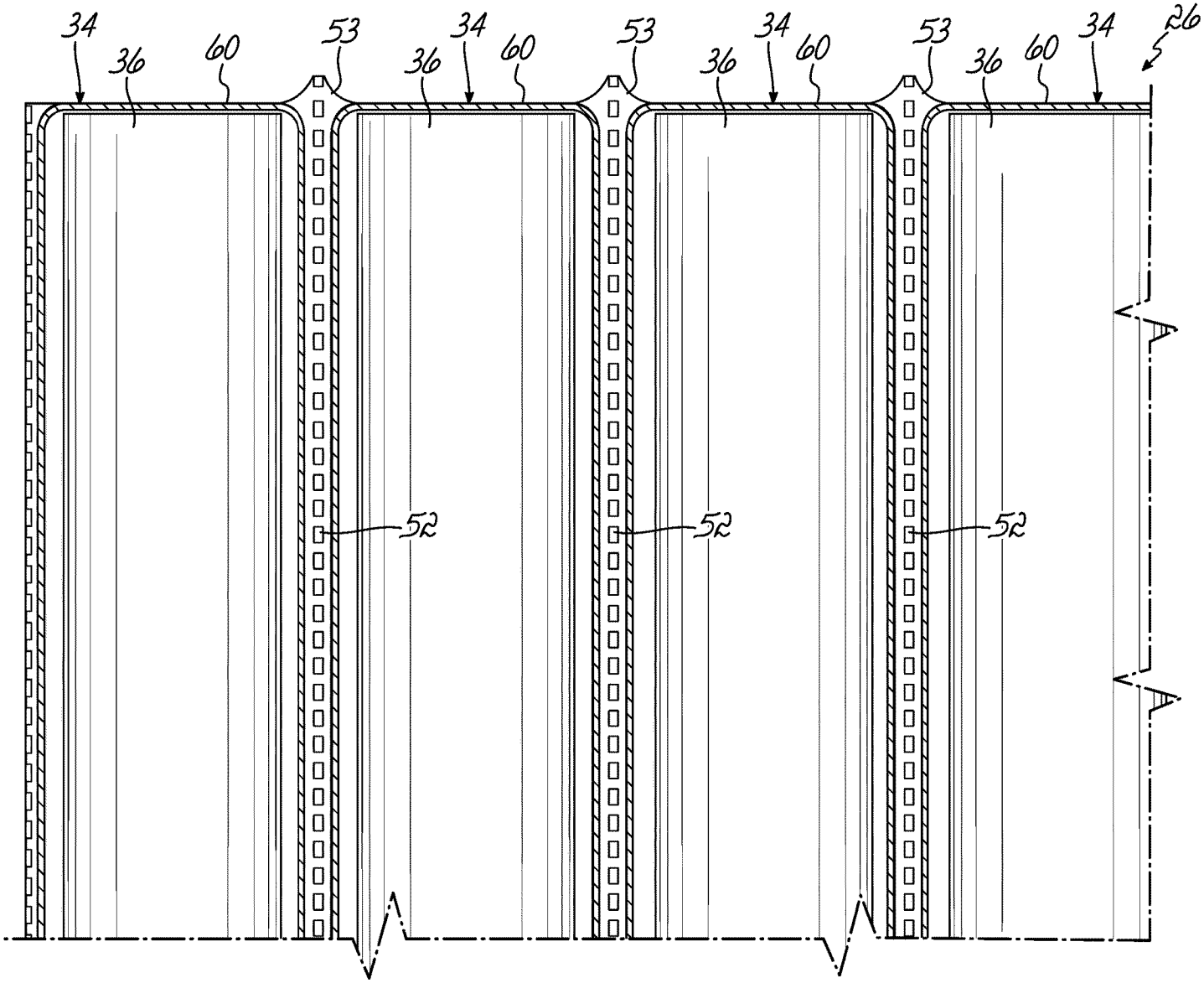
FIG. 4 is a cross-sectional view, partially broken away, of a portion of the string of FIG. 2 in an unloaded condition.
Figure 4A:
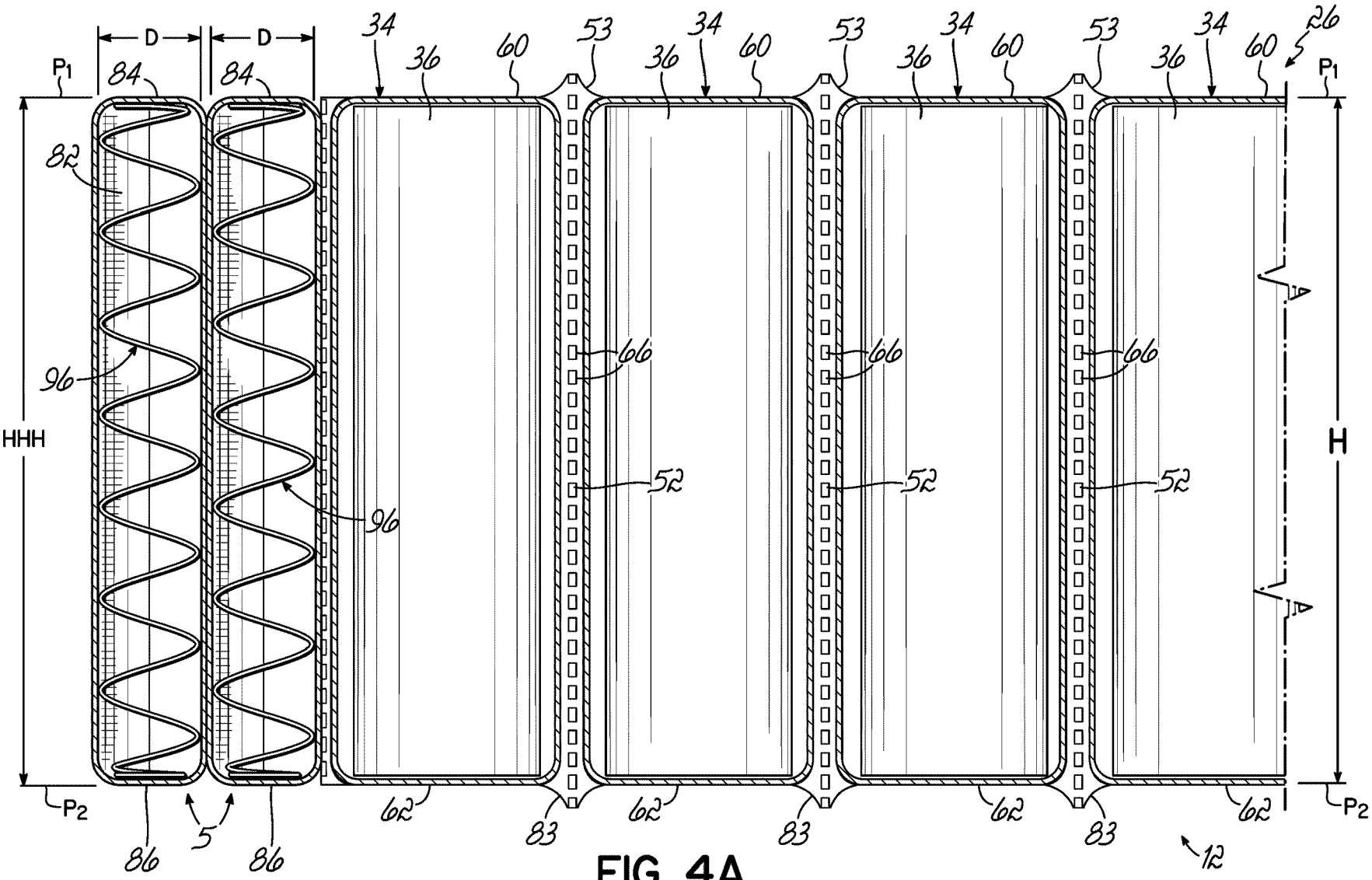
FIG. 4A is a cross-sectional view, partially broken away, of a portion of the string of FIG. 2 in an unloaded condition and a portion of a border comprising pocketed springs.
Figure 4B:
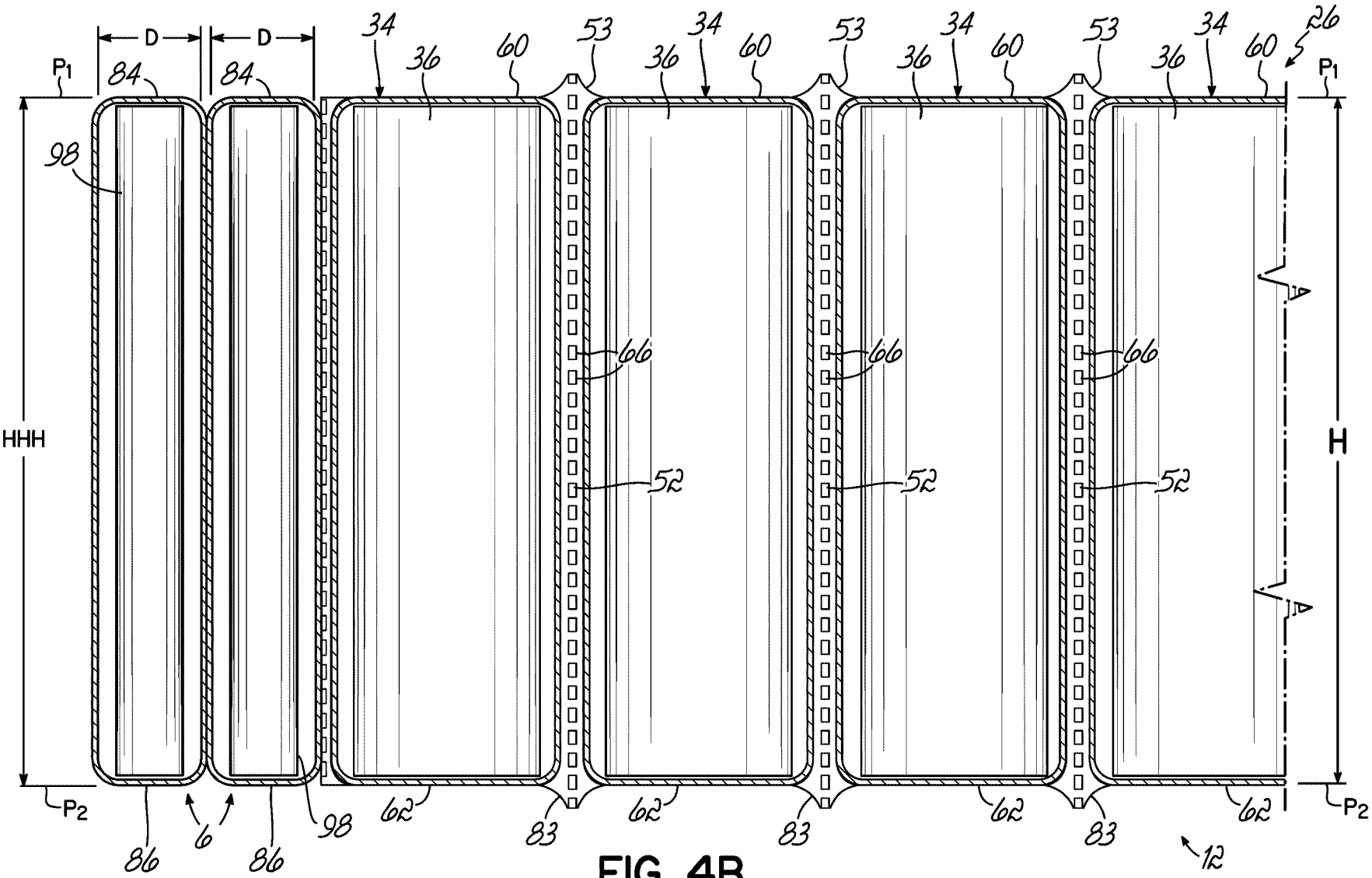
FIG. 4B is a cross-sectional view, partially broken away, of a portion of the string of FIG. 2 in an unloaded condition and a portion of a border comprising pocketed buckling members.

The pocketed buckling member assembly 12 is surrounded by a border 17 comprising longitudinally extending border strings 5 of pocketed members 11 and transversely extending border strings 6 of pocketed members 11. The pocketed members 11 of the border 17 may be of a different diameter (usually smaller) than the diameter of the pocketed buckling members 28 of the pocketed buckling member assembly 12 to increase firmness along at least two edges or sides of the product. The pocketed members 11 of the border 17 may be border coil springs 96 of a diameter "D", as shown in FIG. 4A, or border buckling members 98 of a diameter "D", as shown in FIG. 4B.

Although one type of border 17 is illustrated, the border 17 may assume other forms or shapes of any desired size, such as pocketed border buckling members 98 of different geometries, different compositions, different sizes and/or different properties than the pocketed buckling members 28 of any of the pocketed buckling member assemblies disclosed herein. Alternatively, the border 17 may be omitted in this embodiment or any embodiment described or shown herein.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, the pocketed buckling member assembly 12 is manufactured from multiple strings 26 of pocketed buckling members 28 joined together. Each string 26 of pocketed buckling members 28 extends longitudinally or from head-to-foot along the full length of the product 10.

Figure 1A:
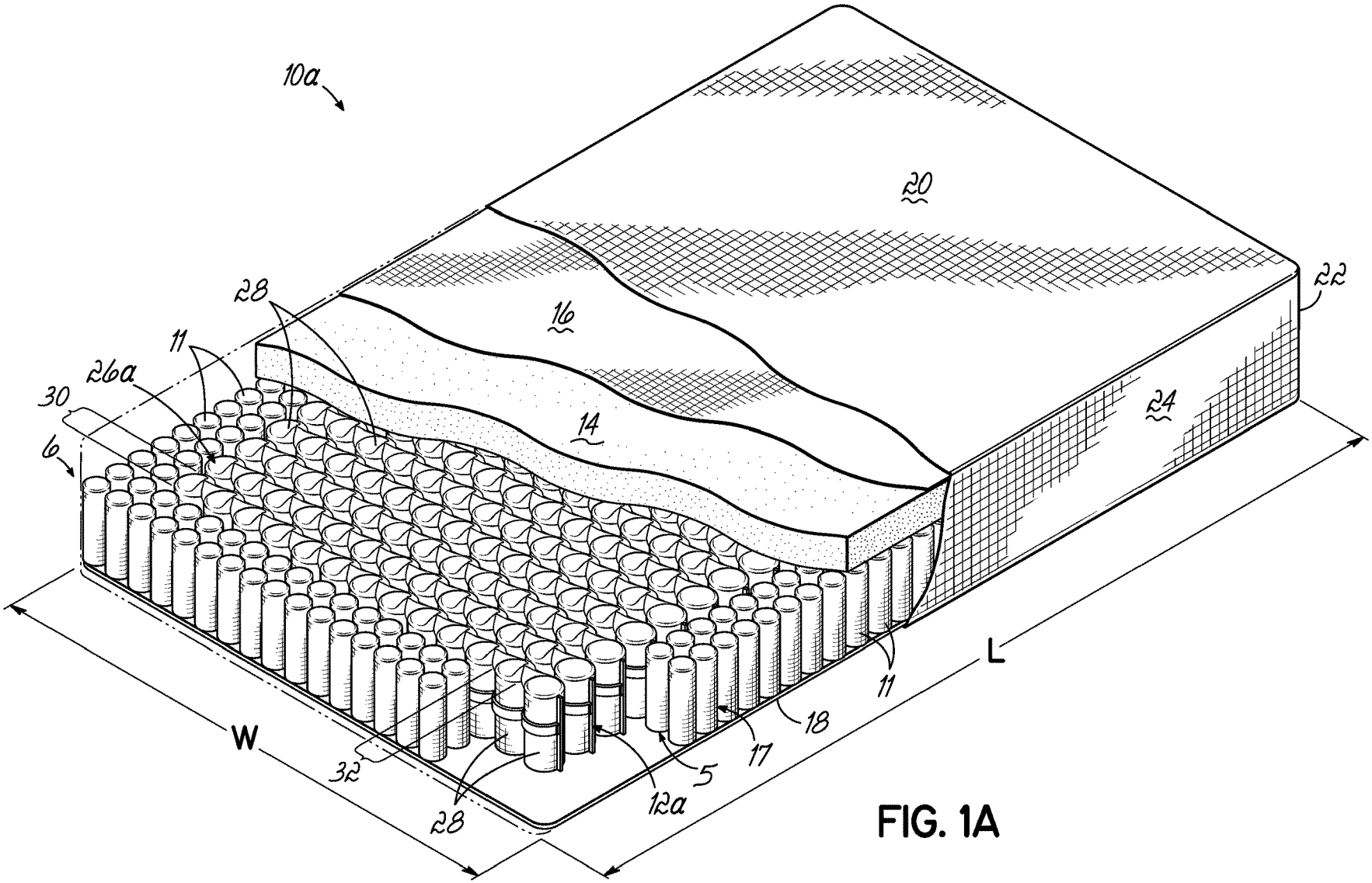
FIG. 1A is a perspective view, partially broken away, of a bedding or seating product incorporating another pocketed buckling member assembly surrounded by a border.

Although the strings 26 of the pocketed buckling member assembly 12 are illustrated as extending longitudinally or from head-to-foot in the pocketed buckling member assembly 12 of FIG. 1, they may extend transversely or from side-to-side as shown in the pocketed buckling member assembly 12*a* shown in the product 10*a* shown in FIG. 1A. The pocketed buckling member assembly 12*a* comprises multiple strings 26*a* of pocketed buckling members, identical to the strings 26, but shorter in length.

Figure 1B:
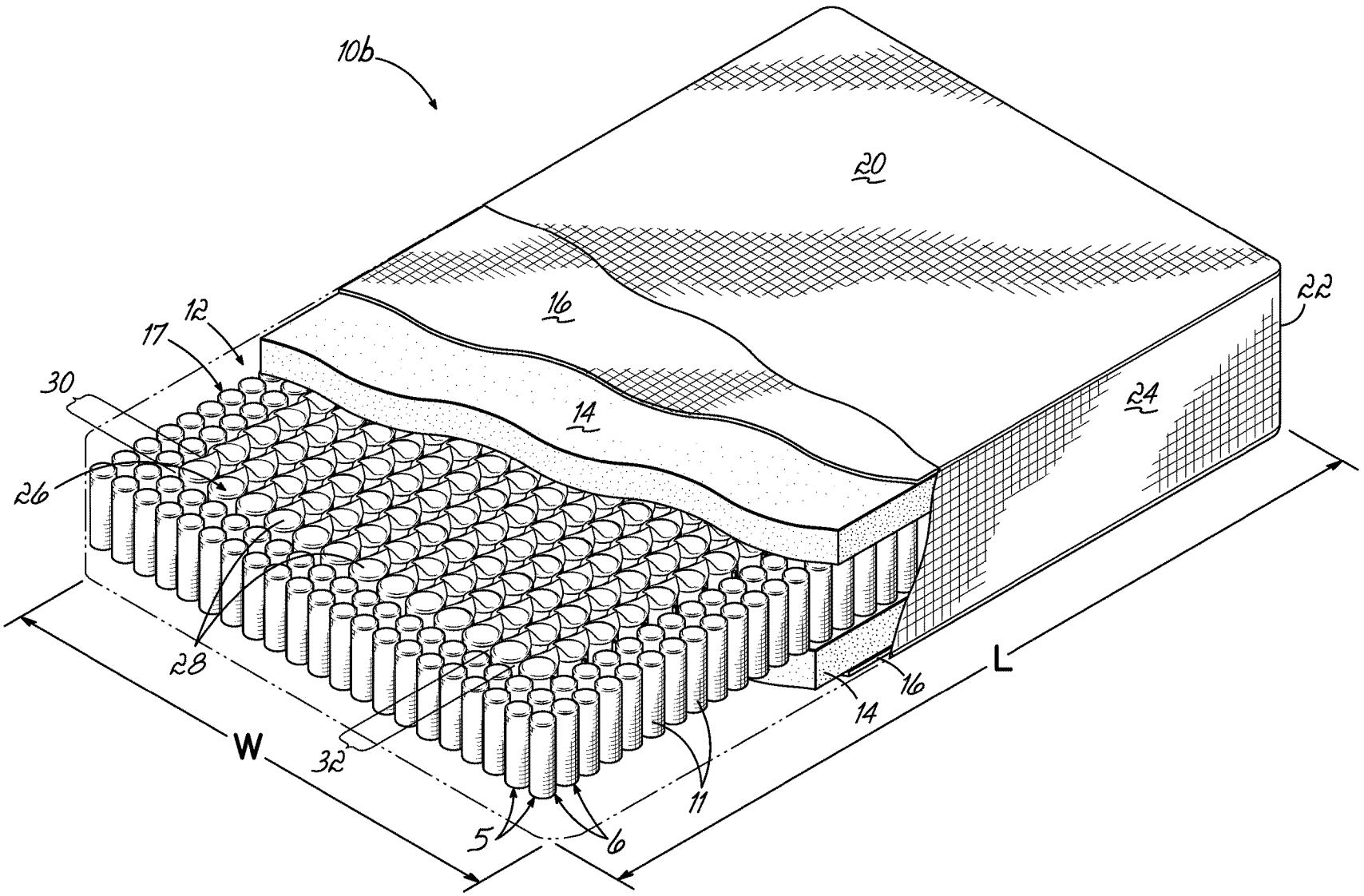
FIG. 1B is a perspective view, partially broken away, of a double-sided bedding product incorporating another pocketed buckling member assembly surrounded by a border.

FIG. 1B illustrates a double-sided mattress 10*b* comprising a pocketed buckling member assembly 12 surrounded with a border 17. However, the mattress 10*b* of FIG. 1B has conventional padding layers 14, 16 above and below a pocketed buckling member assembly 12. The pocketed buckling member assembly 12 comprises a plurality of strings 26 extending from head to foot or longitudinally. However, the transversely extending strings 26*a* of FIG. 1A could be used in a double-sided product including a mattress.

Figure 1C:
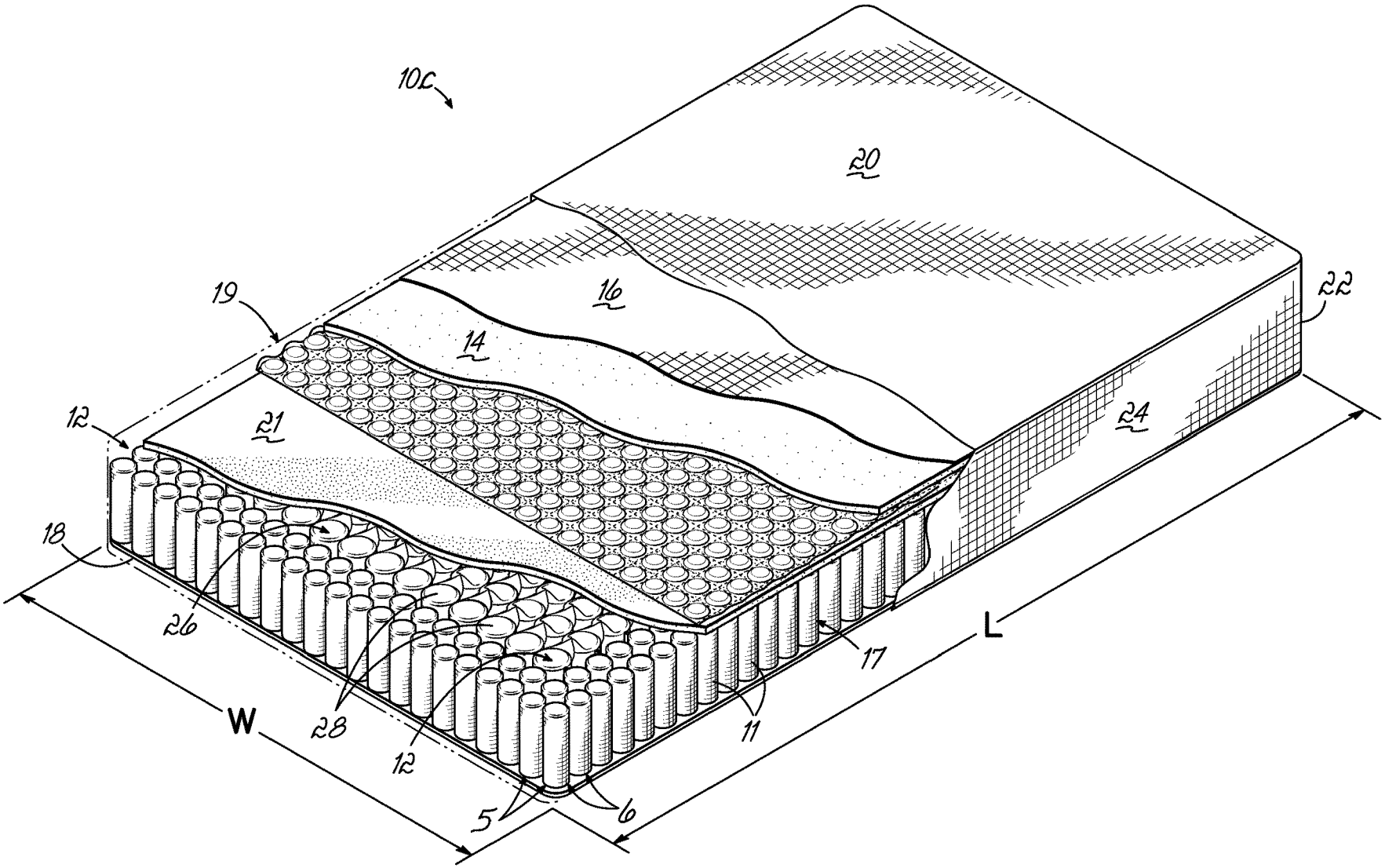
FIG. 1C is a perspective view, partially broken away, of another bedding product incorporating the pocketed buckling member assembly of FIG. 1 surrounded by a border.

FIG. 1C illustrates a single-sided mattress 10*c* comprising a pocketed buckling member assembly 12 surrounded by a border 17. However, the mattress 10*c* of FIG. 1C has a pocketed topper 19 comprising pocketed mini coil springs in addition to padding layers 14, 16 above the pocketed topper 19. A scrim layer 21 separates the pocketed topper 19 from the pocketed spring assembly 12. Although one configuration of pocketed topper 19 is illustrated, any pocketed topper or comfort layer known in the art may be used.

Figure 1D:
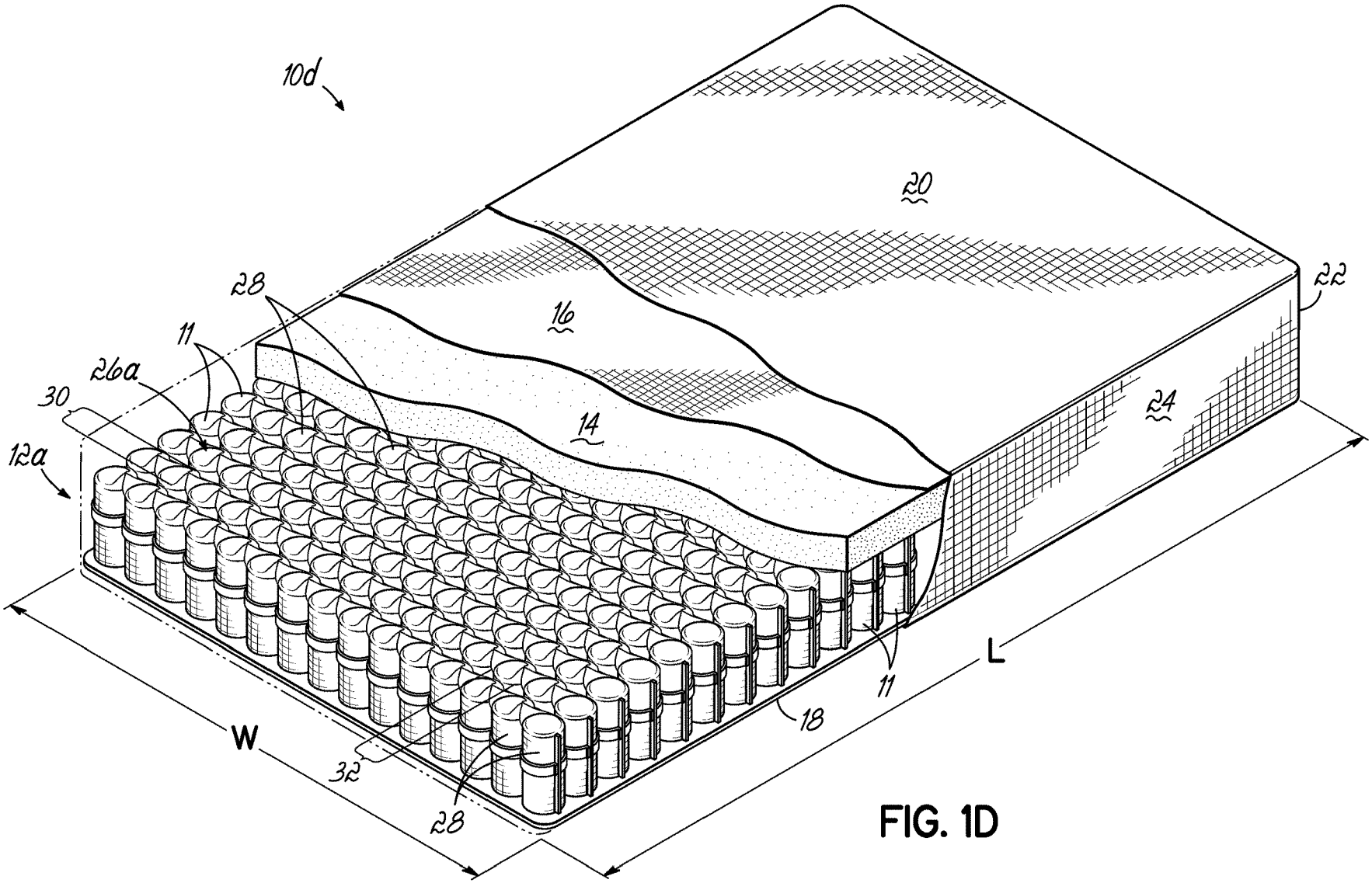
FIG. 1D is a perspective view, partially broken away, of another bedding product incorporating the pocketed buckling member assembly of FIG. 1A.

FIG. 1D illustrates a single-sided mattress 10*d* comprising pocketed buckling member assembly 12*a* the same as in the mattress 10*a* of FIG. 1A. However, the mattress 10*d* of FIG. 1D has no border. Although the strings 26*a* of pocketed buckling member assembly 12*a* extend transversely or from side to side, they may extend longitudinally or from head to foot without a border in any of the embodiments shown or described herein.

Figure 1E:
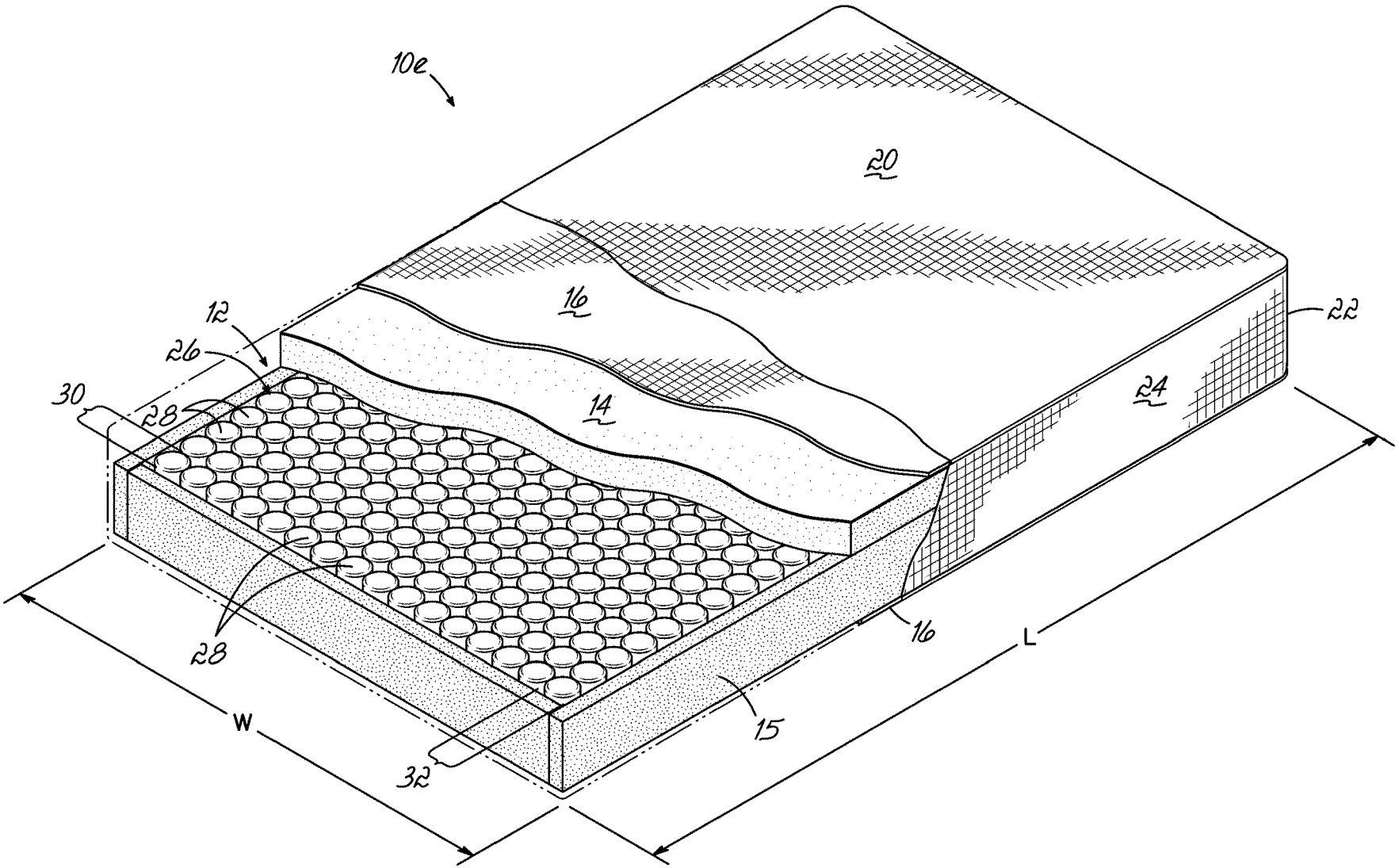
FIG. 1E is a perspective view, partially broken away, of another bedding product incorporating the pocketed buckling member assembly of FIG. 1D surrounded by a foam border.

FIG. 1E illustrates a single-sided mattress 10*e* comprising pocketed buckling member assembly 12 the same as in the mattress 10 of FIG. 1. However, the mattress 10*e* of FIG. 1E has a foam border 15. Although the strings 26 of pocketed buckling member assembly 12 extend longitudinally or from head to foot, they may extend transversely or from side to side in any of the embodiments shown or described herein.

According to this invention, any of the padding or cushioning layers, including the pocketed topper 19, may be omitted in any of the embodiments shown or described herein.

These strings of pocketed buckling members 26 and 26*a*, and any other strings described or shown herein, may be connected in side-by-side relationship as, for example, by gluing the sides of the strings together in an assembly machine, to create an assembly or matrix of springs having multiple rows and columns of pocketed buckling members bound together as by gluing, welding or any other conventional assembly process commonly used to create pocketed spring cores or assemblies.

Figure 5:
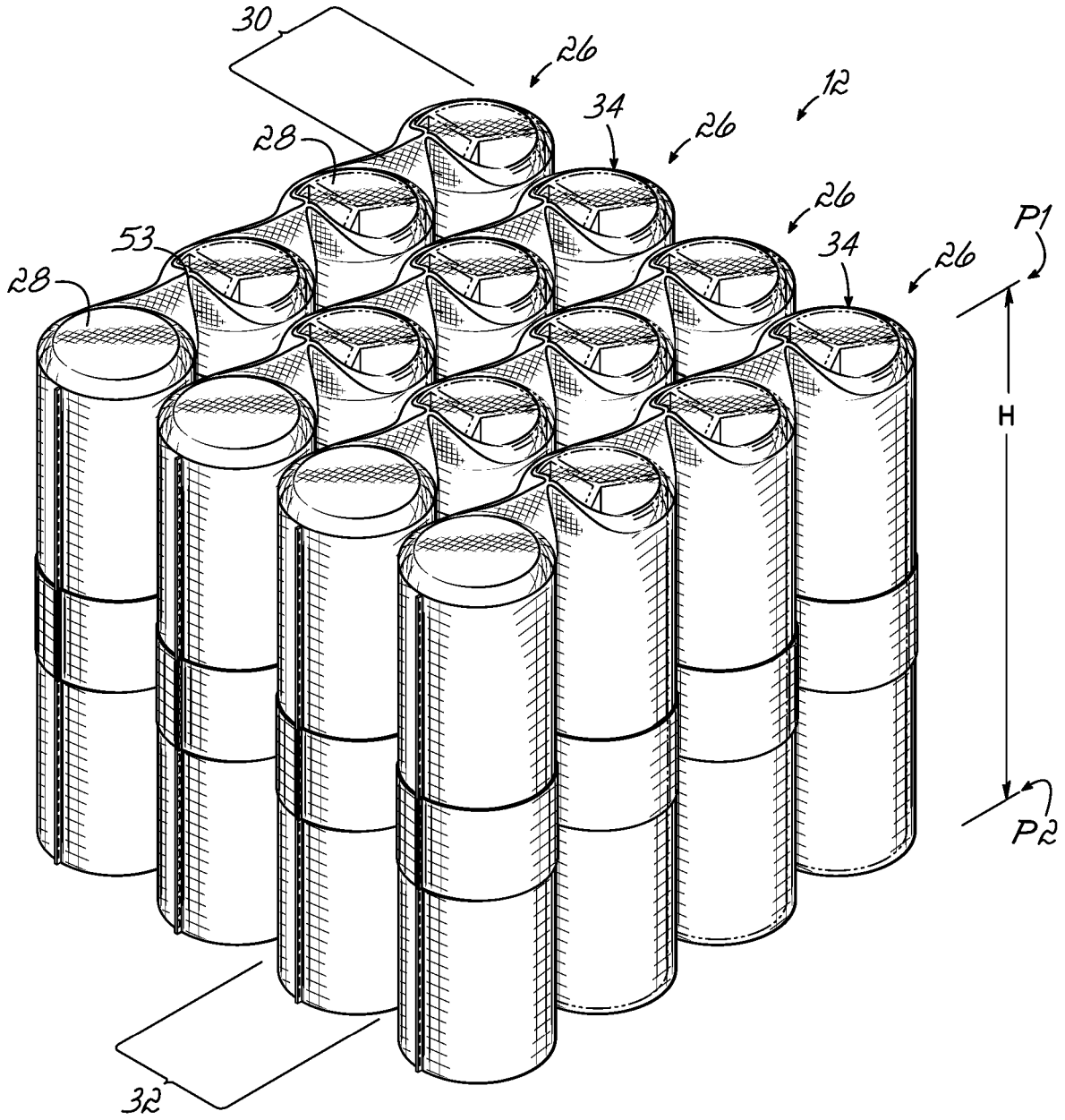
FIG. 5 is a perspective view of a portion of the pocketed buckling member assembly of FIG. 1 in a relaxed condition.
Figure 6:
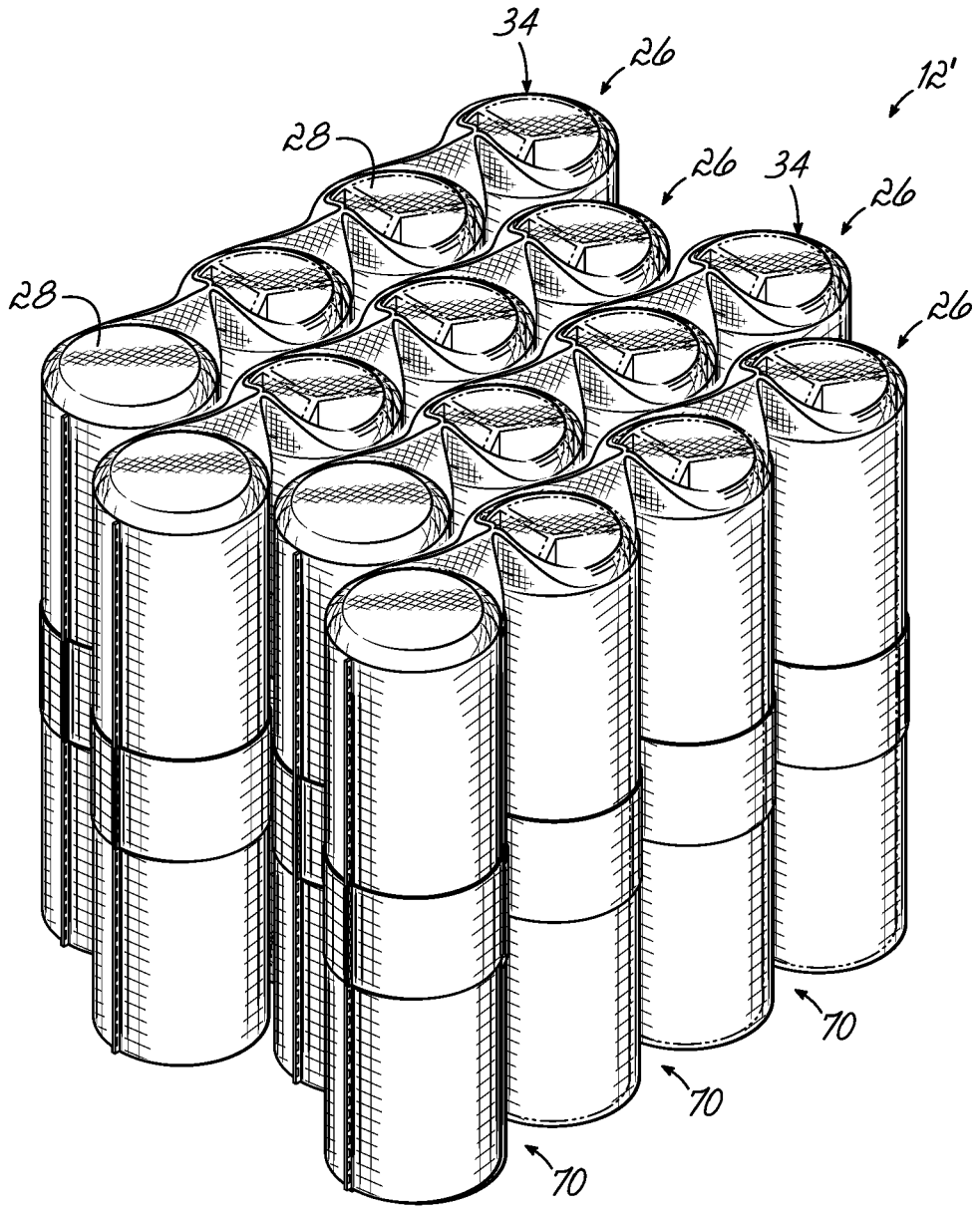
FIG. 6 is a perspective view of a portion of another pocketed buckling member assembly in a relaxed condition, the strings being offset from one another.

Referring to FIGS. 5 and 6, the strings 26 of pocketed buckling members may be joined so that the individually pocketed buckling members 28 are aligned in transversely extending rows 30 and longitudinally extending columns 32. Alternatively, the strings 26 may be offset from one another in a pocketed buckling member assembly. In such an arrangement, shown in FIG. 6, the individually pocketed buckling members 28 are not aligned in rows and columns; instead the individually pocketed buckling members 28 fill gaps or voids 70 of the adjacent strings 26. FIG. 6 shows a portion of a pocketed spring assembly 12' with multiple strings 26 arranged in this manner. Either alignment of strings may be incorporated into any of the pocketed buckling member assemblies or cores illustrated or described herein. Although FIGS. 5 and 6 illustrate strings 26, the same alignments may be used in any pocketed buckling member assembly disclosed herein having any strings disclosed herein including strings 26*a*.

Figure 2:
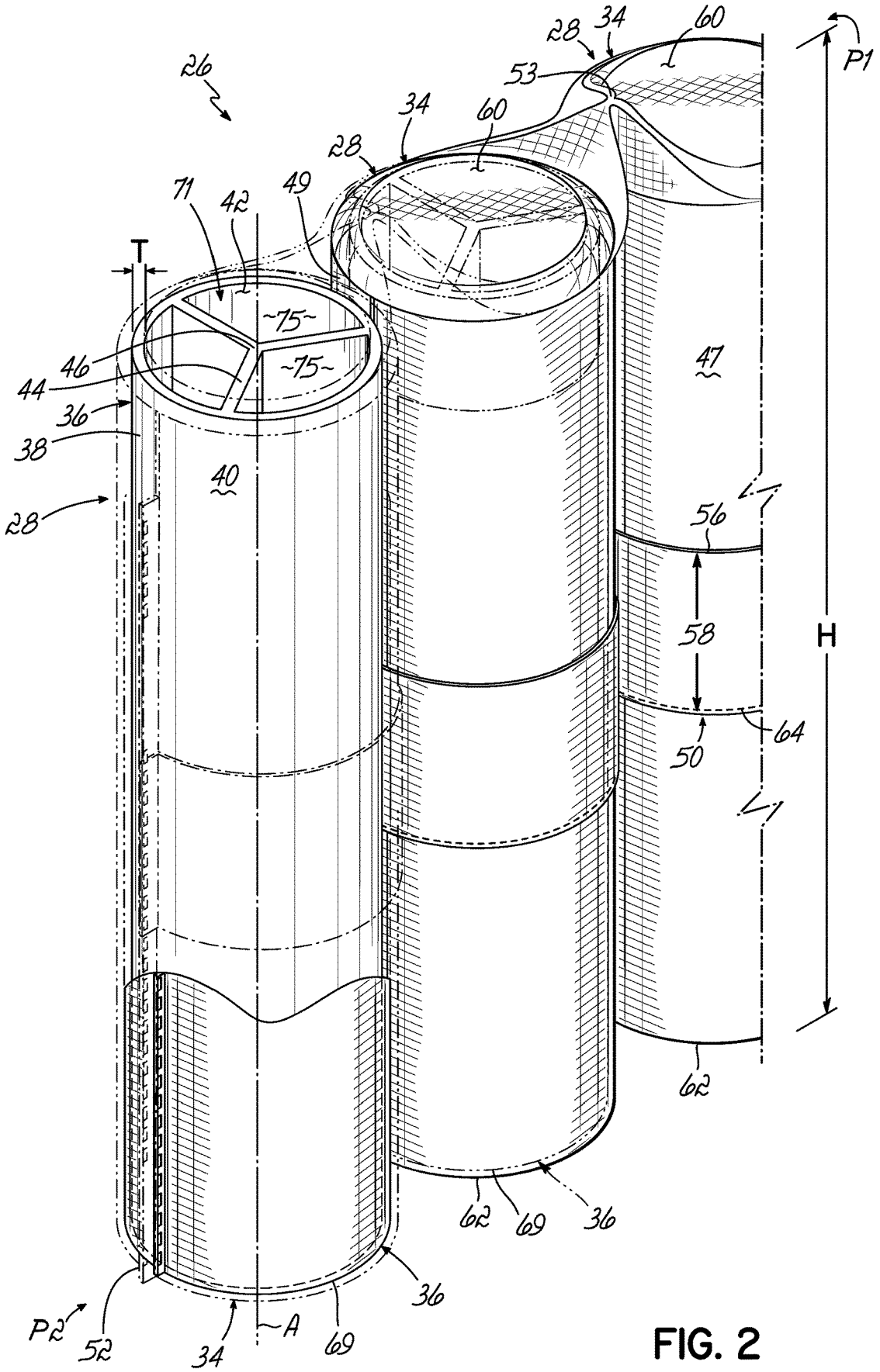
FIG. 2 is a perspective view, partially broken away, of a portion of a string of pocketed buckling members of the pocketed buckling member assembly of FIG. 1 in an unloaded condition.

FIG. 2 illustrates a perspective view of the portion of a string 26 of pocketed buckling members 28 in a relaxed condition under no external load. As best illustrated in FIG. 2, each string 26 of pocketed buckling members 28 comprises a row of interconnected fabric pockets 34. Each of the fabric pockets 34 contains a single buckling member 36 and no other items. In other words, each of the fabric pockets 34 contains solely a single buckling member 36.

Preferably, one piece of fabric is used to create the pockets 34 of the string 26 of pocketed buckling members 28, the piece of fabric being folded over onto itself around the buckling members 28. As best shown in FIG. 2, opposite sides or plies 47, 49 of the fabric are sewn, welded or otherwise secured together to create a longitudinal seam 50 and a plurality of separating or transverse seams 52. FIG. 2 illustrates ply 47 being closest to the reader and ply 49 being behind the buckling members 28.

Although the seams or welds in the embodiments shown herein are shown as being welded spaced rectangles, any of the seams may be spaced dots, triangles or solid line segments without spaces.

As best shown in FIG. 2, opposed edges 56 of the piece of fabric used to create the string 26 of pocketed buckling members 28 are aligned and spaced from the longitudinal seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 2, 4A and 4B, the piece of fabric used to create the string 26 has a plurality of upper ears 53 and a plurality of lower ears 83. When the ears are collapsed, the string 26 has a generally planar top surface 60 in a top plane P1 and a parallel generally planar bottom surface 62 in a bottom plane P2. The linear distance between the top and bottom surfaces 60, 62 of the string 26 defines a height "H" of the string 26. This linear distance further defines the height H of the pocketed spring assembly 12 because each of the strings 26 has the same height. However, it is within the scope of the present invention that different strings of springs of a pocketed spring assembly have different heights.

As shown in FIGS. 4A and 4B, in one embodiment, the transverse seams 52 of string 26 separating adjacent pockets extend from the top of an upper ear 53 of fabric to the bottom of a lower ear 83 of fabric. However, the transverse seams 52 may be any desired length.

An ultrasonically weldable fabric is used to create the string of pocketed buckling members 26. The ultrasonically weldable fabric is permeable to airflow through the fabric itself due to the nature of the fabric. Air moves between adjacent fabric pockets 38 and into and out of the string 26 through the ultrasonically weldable fabric.

As best shown in FIG. 2, the longitudinal seam 52 comprises multiple spaced linear weld segments 64 formed using an ultrasonic welding horn and anvil (not shown) as known in the art. At least some of the longitudinal seams 52 of a string may not be segmented or be only partially segmented. For example, the longitudinal seam 52 of a string may not be segmented at all.

As best shown in FIGS. 4A and 4B, each transverse or separating seam 52 comprises multiple spaced linear weld segments 66 formed using an ultrasonic welding horn and anvil (not shown) to join the opposed sides or plies 47, 49 of the ultrasonically weldable fabric. Again, at least some of the transverse or separating seams 52 of a string may not be segmented or may be only partially segmented. For example, one or more transverse seams 52 of a string may be partially segmented or not be segmented at all. Although the weld segments in the embodiments shown are illustrated as being heat-welded spaced rectangular-shaped segments, any of the seam segments may be other shapes, such as spaced dots, ovals or triangles of any desired sizes.

Figure 3:
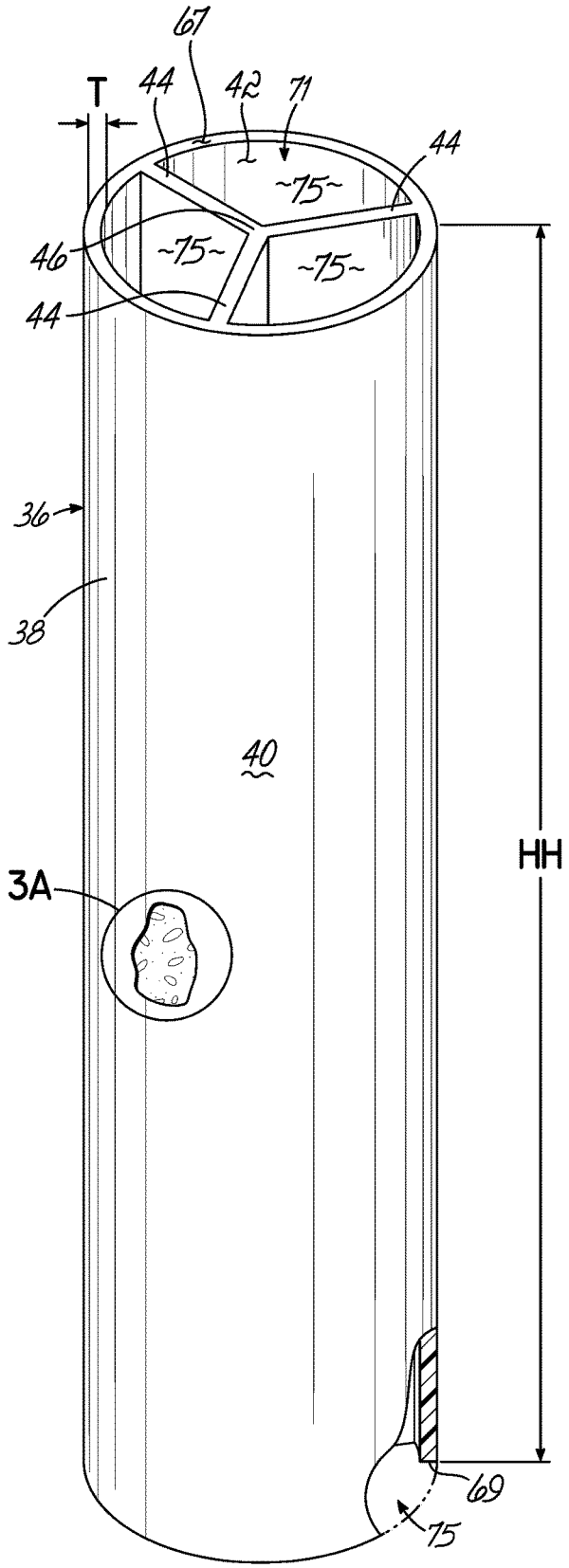
FIG. 3 is a perspective view of a buckling member in a relaxed or unloaded condition.

As best shown in FIGS. 2 and 3, the buckling member 36 is shown as being cylindrically shaped member like a can. Buckling member 36 is illustrated having an outer wall 38 having an outer surface 40 and an inner surface 42, the distance between which defines the thickness "T" of the outer wall 38. The buckling member 36 has three internal ribs 44 which extend from the outer wall 38 to a center 46. The buckling member 36 has a generally planar upper surface 67 and a generally planar lower surface 69 which define the height "HH" of the buckling member 36. The buckling member 36 has an open top 71 and open bottom 73 defining three passages 75 between the internal ribs 44. Although the drawings illustrate one thickness "T" of outer wall 38, the outer wall may be any desired thickness. Although the drawings illustrate the internal ribs 44 having one thickness, the internal ribs may be any desired thickness.

In any embodiment shown or described herein, any of the buckling members 36; 36*a*-36*h*, 36*t* or 36*tt* shown or described herein can be made of acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

Figure 3A:
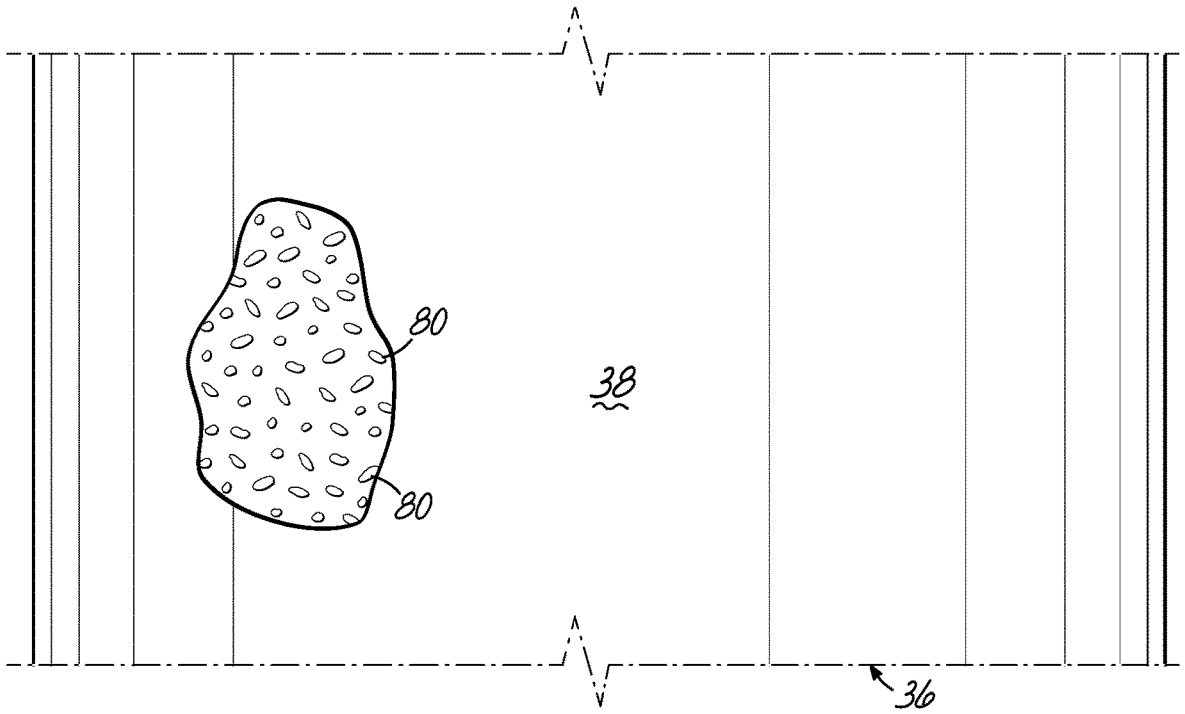
FIG. 3A is a perspective view of the circled area 3A of FIG. 3 showing an additive incorporated into the buckling member.

Regardless of the material used to make the buckling member 36, additives 80 such as slow-release fragrances, antimicrobial additives such as copper and silver, color additives, thermochromic materials, bed bug inhibitors, conductive additives such as graphite, aluminum powder, silicon carbide and diamond dust may be incorporated into the material. Density reducing agents such as fumed silica or gas generating materials may be added too. FIG. 3A illustrates additives 80 incorporated into the material of the buckling member 36.

As shown in FIGS. 2 and 3, the piece of fabric used to create the string 26 has a plurality of upper ears 53 and a plurality of lower ears 83. When the ears are collapsed, the string 26 has a generally planar top surface 60 in a top plane P1 and a parallel generally planar bottom surface 62 in a bottom plane P2. The linear distance between the top and bottom surfaces 60, 62 of the string 26 defines a height "H" of the string 26. This linear distance further defines the height H of the pocketed spring assembly 12 because each of the strings 26 has the same height. However, it is within the scope of the present invention that different strings of springs of a pocketed spring assembly have different heights.

As shown in FIGS. 2 and 3, in one embodiment, the transverse seams 52 of string 26 separating adjacent pockets extend from the top of an upper ear 53 of fabric to the bottom of a lower ear 83 of fabric.

FIG. 4A illustrates one embodiment of mattress 10 having a pocketed buckling member assembly 12 and border strings 6 of pocketed border coil springs 96 extending perpendicular to the head-to-foot or longitudinal direction of the strings 26 of buckling members 36. Each of the border strings 6 extends from side-to-side or transversely. Each border string 6 comprises a single piece of fabric made into a plurality of individual border pockets 82 of the same height HHH defined as the linear distance between an upper surface 84 of the pocket in plane P1 and a lower surface 86 of the border pocket 82 located in plane P2. The height HHH of the border strings 6 is preferably identical to the height H of the pockets 34 of the pocketed buckling member assembly 12. However, these heights may be different. A coil spring 96 having a diameter D is located in each of the border pockets 82. Although one configuration of coil spring 96 is illustrated any known coil spring may be used.

Although not shown, each of the border strings 5 extending from head-to-foot or longitudinally may contain a coil spring 96 and may be any desired height.

FIG. 4B illustrates a view like FIG. 4A but showing border buckling members 88 in place of coil springs 96 in the border pockets 82. Each of the border buckling members 88 is shown having a diameter D, the same as the diameter of the coil springs 96. However, the border buckling members 88 may have any desired diameter.

FIGS. 7A-7H illustrate top views of different buckling members which may be substituted for the buckling members 36 shown and described herein. Although each of the buckling members shown in FIGS. 7A-7H are illustrated being un-pocketed any of them may be individually pocketed. Regardless of the material used to make any of the buckling members, additives 80 such as phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials may be incorporated into the material. Density reducing agents such as fumed silica or gas generating materials may be added too.

Figure 7A:
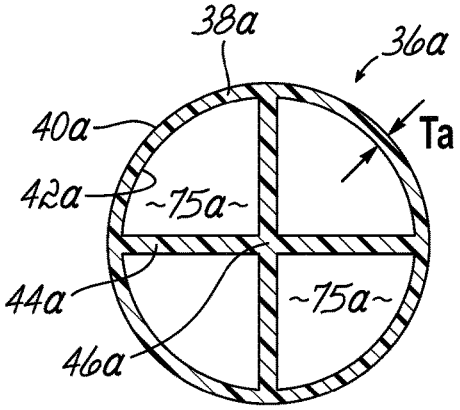
FIG. 7A is a top view of an alternative buckling member.

FIG. 7A illustrates a cross-sectional view of another cylindrical shaped buckling member 36*a* which may be used in any embodiment of string shown or described herein. Buckling member 36*a* is illustrated having a circular outer wall 38*a* having an outer surface 40*a* and an inner surface 42*a*, the distance between which defines the thickness "Ta" of the circular outer wall 38*a*. The buckling member 36*a* has four internal ribs 44*a* which extend from the outer wall 38*a* to a center 46*a*. The buckling member 36*a* may be any desired height. The buckling member 36*a* has an open top and open bottom defining four internal passages 75*a* between the internal ribs 44*a* and outer wall 38*a*. Although the drawings illustrate one thickness "Ta" of outer wall 38*a*, the outer wall 38*a* may be any desired thickness. Although the drawings illustrate the internal ribs 44*a* having one thickness, the internal ribs may be any desired thickness.

Figure 7B:
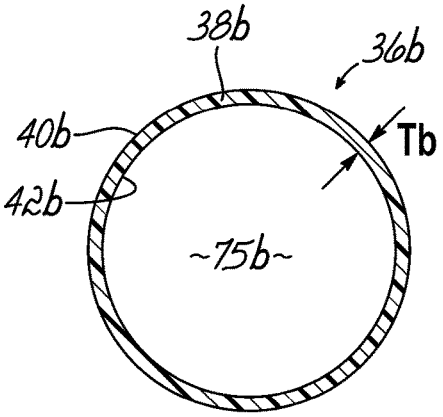
FIG. 7B is a top view of an alternative buckling member.

FIG. 7B illustrates a cross-sectional view of another cylindrical shaped buckling member 36*b* which may be used in any embodiment of string shown or described herein. Buckling member 36*b* is illustrated having a circular outer wall 38*b* having an outer surface 40*b* and an inner surface 42*b*, the distance between which defines the thickness "Tb" of the circular outer wall 38*b*. The buckling member 36*b* has no internal ribs and may be any desired height. The buckling member 36*b* has an open top and open bottom defining one internal passage 75*b* inside outer wall 38*b*. Although the drawings illustrate one thickness "Tb" of outer wall 38*b*, the outer wall 38*b* may be any desired thickness.

Figure 7C:
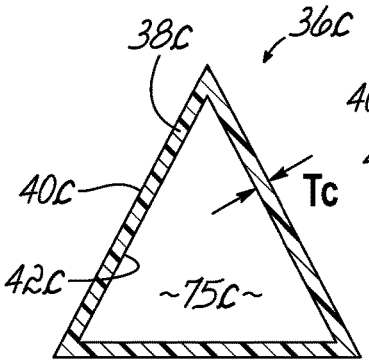
FIG. 7C is a top view of an alternative buckling member.

FIG. 7C illustrates a cross-sectional view of another buckling member 36*c* which may be used in any embodiment of string shown or described herein. Buckling member 36*c* is illustrated having a triangular shaped outer wall 38*c* having an outer surface 40*c* and an inner surface 42*c*, the distance between which defines the thickness "Tc" of the triangular outer wall 38*c*. The buckling member 36*c* may be any desired height. The buckling member 36*c* has an open top and open bottom defining one internal passage 75*c* inside outer wall 38*c*. Although the drawings illustrate one thickness "Tc" of outer wall 38*c*, the outer wall 38*c* may be any desired thickness.

Figure 7D:
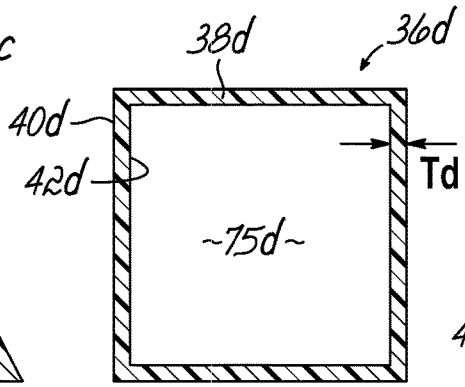
FIG. 7D is a top view of an alternative buckling member.

FIG. 7D illustrates a cross-sectional view of another buckling member 36*d* which may be used in any embodiment of string shown or described herein. Buckling member 36*d* is illustrated having a square shaped outer wall 38*d* having an outer surface 40*d* and an inner surface 42*d*, the distance between which defines the thickness "Td" of the square outer wall 38*d*. The buckling member 36*d* may be any desired height. The buckling member 36*d* has an open top and open bottom defining one internal passage 75*d* inside outer wall 38*d*. Although the drawings illustrate one thickness "Td" of outer wall 38*d*, the outer wall 38*d* may be any desired thickness.

Figure 7E:
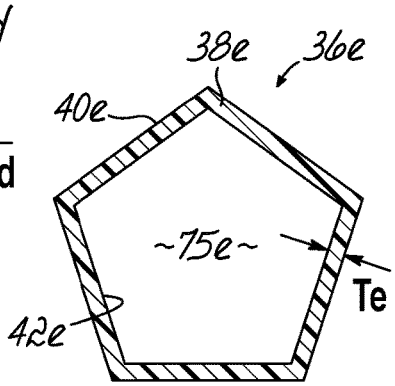
FIG. 7E is a top view of an alternative buckling member.

FIG. 7E illustrates a cross-sectional view of another buckling member 36*e* which may be used in any embodiment of string shown or described herein. Buckling member 36*e* is illustrated having a pentagon shaped outer wall 38*e* having an outer surface 40*e* and an inner surface 42*e*, the distance between which defines the thickness "Te" of the pentagon outer wall 38*e*. The buckling member 36*e* may be any desired height. The buckling member 36*e* has an open top and open bottom defining one internal passage 75*e* inside outer wall 38*e*. Although the drawings illustrate one thickness "Te" of outer wall 38*e*, the outer wall 38*e* may be any desired thickness.

Figure 7F:
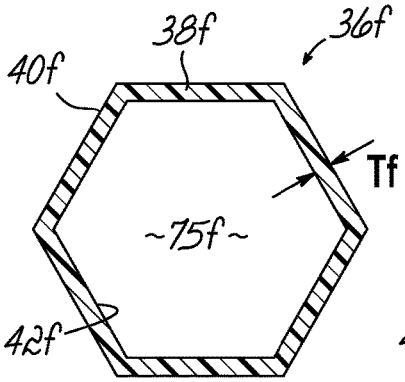
FIG. 7F is a top view of an alternative buckling member.

FIG. 7F illustrates a cross-sectional view of another buckling member 36*f* which may be used in any embodiment of string shown or described herein. Buckling member 36*f* is illustrated having a hexagon shaped outer wall 38*f* having an outer surface 40*f* and an inner surface 42*f*, the distance between which defines the thickness "Tf" of the hexagon outer wall 38*f*. The buckling member 36*f* may be any desired height. The buckling member 36*f* has an open top and open bottom defining one internal passage 75*f* inside outer wall 38*f*. Although the drawings illustrate one thickness "Tf" of outer wall 38*f*, the outer wall 38*f* may be any desired thickness.

Figure 7G:
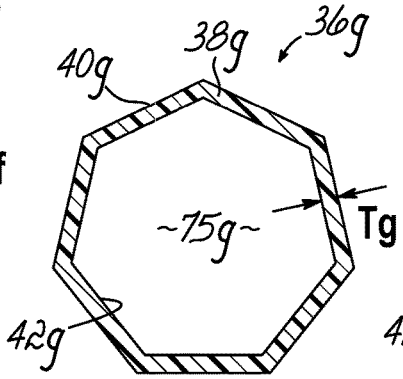
FIG. 7G is a top view of an alternative buckling member.

FIG. 7G illustrates a cross-sectional view of another buckling member 36*g* which may be used in any embodiment of string shown or described herein. Buckling member 36*g* is illustrated having a heptagon shaped outer wall 38*g* having an outer surface 40*g* and an inner surface 42*g*, the distance between which defines the thickness "Tg" of the pentagon outer wall 38*g*. The buckling member 36*g* may be any desired height. The buckling member 36*g* has an open top and open bottom defining one internal passage 75*g* inside outer wall 38*g*. Although the drawings illustrate one thickness "Tg" of outer wall 38*g*, the outer wall 38*g* may be any desired thickness.

Figure 7H:
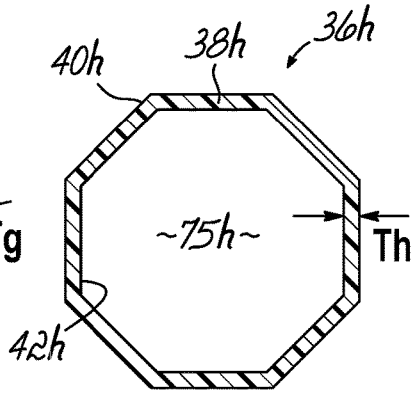
FIG. 7H is a top view of an alternative buckling member.

FIG. 7H illustrates a cross-sectional view of another buckling member 36*h* which may be used in any embodiment of string shown or described herein. Buckling member 36*h* is illustrated having an octagon shaped outer wall 38*h* having an outer surface 40*h* and an inner surface 42*h*, the distance between which defines the thickness "Th" of the pentagon outer wall 38*h*. The buckling member 36*h* may be any desired height. The buckling member 36*h* has an open top and open bottom defining one internal passage 75*h* inside outer wall 38*h*. Although the drawings illustrate one thickness "Th" of outer wall 38*h*, the outer wall 38*h* may be any desired thickness.

Figure 7I:
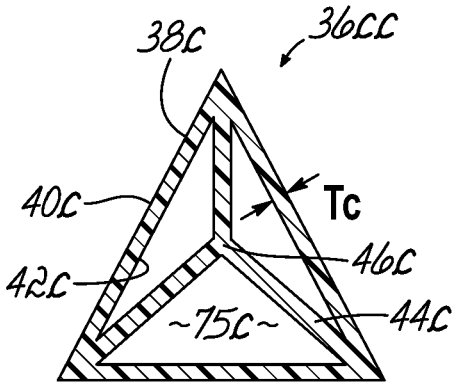
FIG. 7I is a top view of an alternative buckling member.

FIG. 7I illustrates a cross-sectional view of another buckling member 36*cc* which may be used in any embodiment of string shown or described herein. Buckling member 36*cc* is illustrated having the same configuration and structure as buckling member 36*c* but additionally has internal ribs 44*c*. Each of the internal ribs 44*c* extends from the outer wall 38*c* and converge at a center 46*c*. Although three internal ribs 44*c* are illustrated, any number of additional ribs may be added.

Figure 7J:
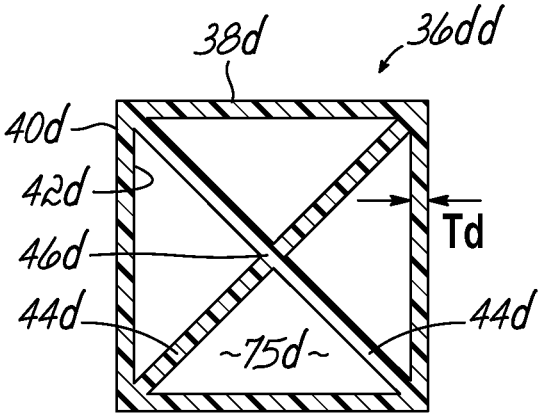
FIG. 7J is a top view of an alternative buckling member.

FIG. 7J illustrates a cross-sectional view of another buckling member 36*dd* which may be used in any embodiment of string shown or described herein. Buckling member 36*dd* is illustrated having the same configuration and structure as buckling member 36*d* but additionally has internal ribs 44*d*. Each of the internal ribs 44*d* extends from the outer wall 38*d* and ends at a center 46*d*. Although four internal ribs 44*d* are illustrated, any number of additional ribs may be added.

Figure 7K:
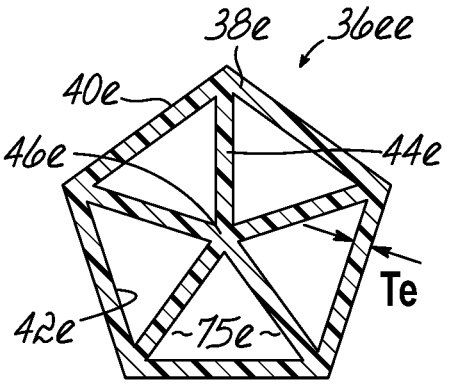
FIG. 7K is a top view of an alternative buckling member.

FIG. 7K illustrates a cross-sectional view of another buckling member 36*ee* which may be used in any embodiment of string shown or described herein. Buckling member 36*ee* is illustrated having the same configuration and structure as buckling member 36*e* but additionally has internal ribs 44*e*. Each of the internal ribs 44*e* extends from the outer wall 38*c* and ends at a center 46*e*. Although five internal ribs 44*e* are illustrated, any number of additional ribs may be added.

Figure 7L:
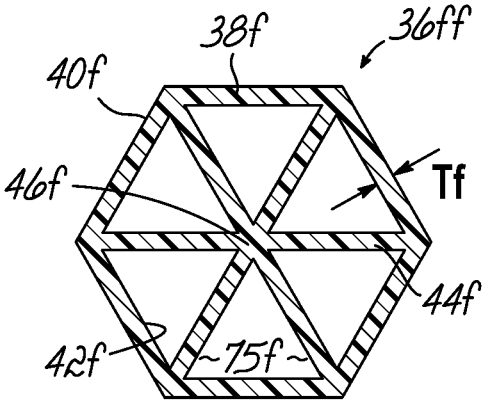
FIG. 7L is a top view of an alternative buckling member.

FIG. 7L illustrates a cross-sectional view of another buckling member 36*ff* which may be used in any embodiment of string shown or described herein. Buckling member 36*ff* is illustrated having the same configuration and structure as buckling member 36*f* but additionally has internal ribs 44*f*. Each of the internal ribs 44*f* extends from the outer wall 38*f* and ends at a center 46*f*. Although five internal ribs 44*f* are illustrated, any number of additional ribs may be added.

Figure 7M:
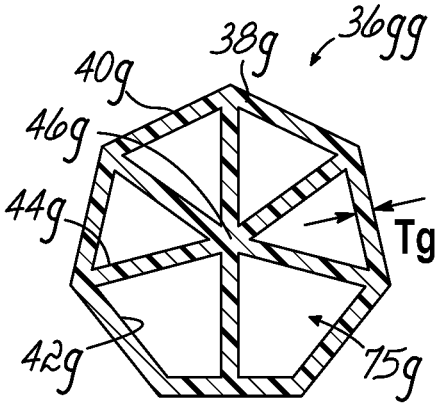
FIG. 7M is a top view of an alternative buckling member.

FIG. 7M illustrates a cross-sectional view of another buckling member 36*gg* which may be used in any embodiment of string shown or described herein. Buckling member 36*gg* is illustrated having the same configuration and structure as buckling member 36*g* but additionally has internal ribs 44*g*. Each of the internal ribs 44*g* extends from the outer wall 38*g* and ends at a center 46*g*. Although six internal ribs 44*g* are illustrated, any number of additional ribs may be added.

Figure 7N:
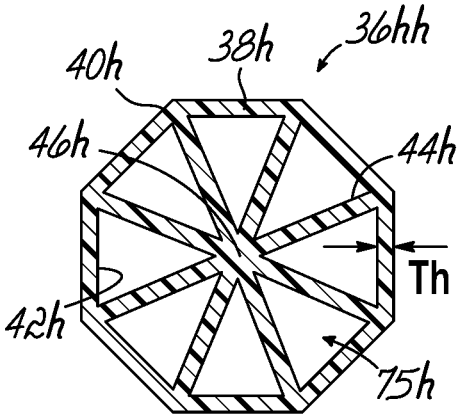
FIG. 7N is a top view of an alternative buckling member.

FIG. 7N illustrates a cross-sectional view of another buckling member 36*hh* which may be used in any embodiment of string shown or described herein. Buckling member 36*hh* is illustrated having the same configuration and structure as buckling member 36*h* but additionally has internal ribs 44*h*. Each of the internal ribs 44*h* extends from the outer wall 38*h* and ends at a center 46*h*. Although eight internal ribs 44*h* are illustrated, any number of additional ribs may be added.

Figure 8:
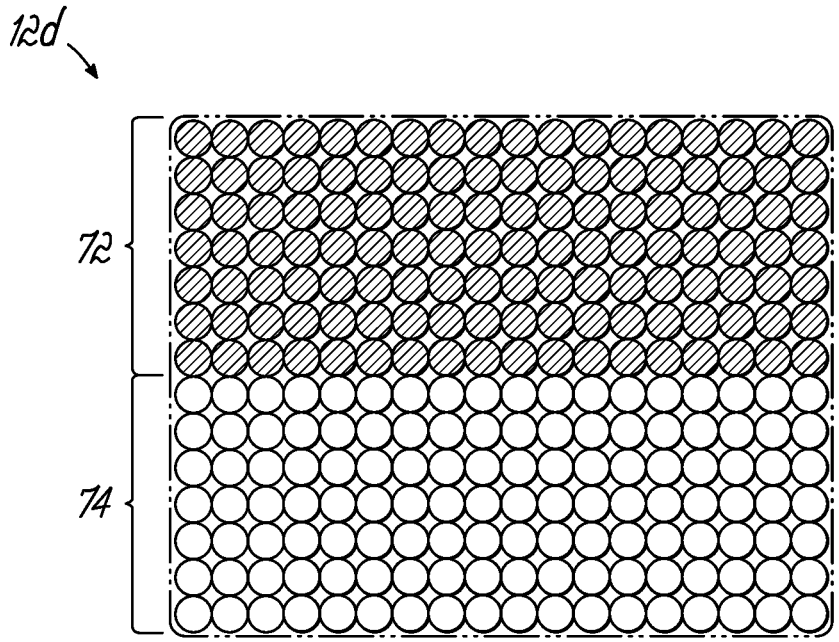
FIG. 8 is a top view of a posturized pocketed spring assembly.

Referring now to FIG. 8, longitudinally extending strings are shown in one preferable arrangement for a pocketed spring assembly for a bedding or seating product, such as a mattress. As can be seen, the longitudinally extending strings are arranged in a plurality of zones on the pocketed spring assembly 12*d*. By way of example, two zones 72, 74 are illustrated, with the zones corresponding roughly to a "firm" side and a "soft" side. By way of further example, the longitudinally extending strings of the "soft" zone 72 may have a different buckling member 36 than the buckling members 36 of the longitudinally extending strings of the "firm" zone 74. Of course, other arrangements are within the scope of the invention. For example, a pocketed spring assembly like pocketed spring assembly 12*d* shown in FIG. 8 may comprise transversely extending strings rather than longitudinally extending strings. In such an arrangement, each transversely extending string would have to be half firm and half soft. In one example, each string would have different buckling members.

Figure 9:
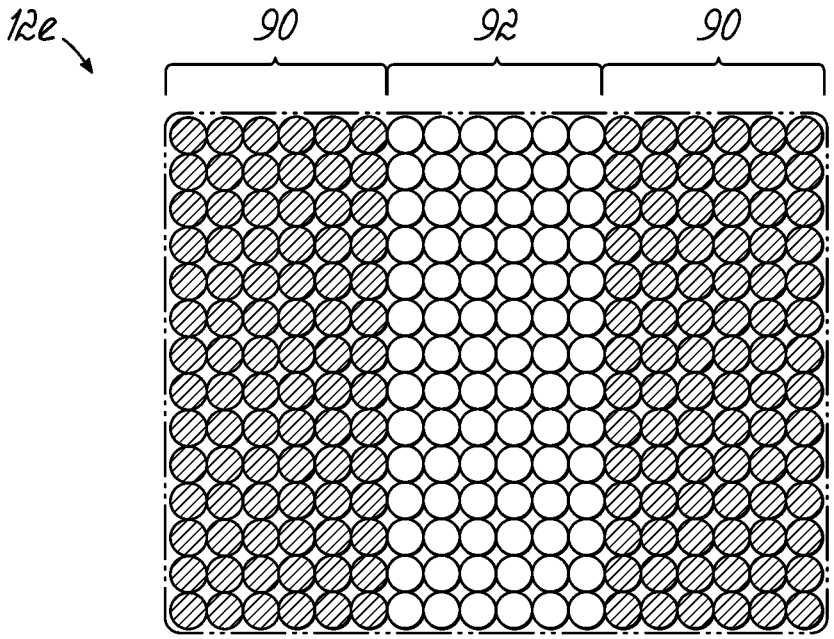
FIG. 9 is a top view of another posturized pocketed spring assembly.

Referring now to FIG. 9, the transversely extending strings are shown in one preferable arrangement for a pocketed spring assembly 12*e* for a bedding or seating product, such as a mattress. As can be seen, the transversely extending strings are arranged in a plurality of zones on the pocketed spring assembly 12*e*. By way of example, three zones are illustrated, with the zones corresponding roughly to the location of a sleeper's head and shoulders, mid-section, knees and feet. By way of further example, the two end "soft" zones 90 each comprise strings of springs having a softer buckling members than the buckling members of the transversely extending strings of the middle or "firm" zone 92 are strings. Of course, other arrangements are within the scope of the invention. For example, the mattress shown in FIG. 9 may comprise longitudinally extending strings rather than transversely extending strings. In such an arrangement, each longitudinally extending string would have to be divided into three sections; a middle "firm" section and two end or "soft" sections. Therefore, each string would have only the end thirds of the string having softer buckling members than the middle third.

Figure 10:
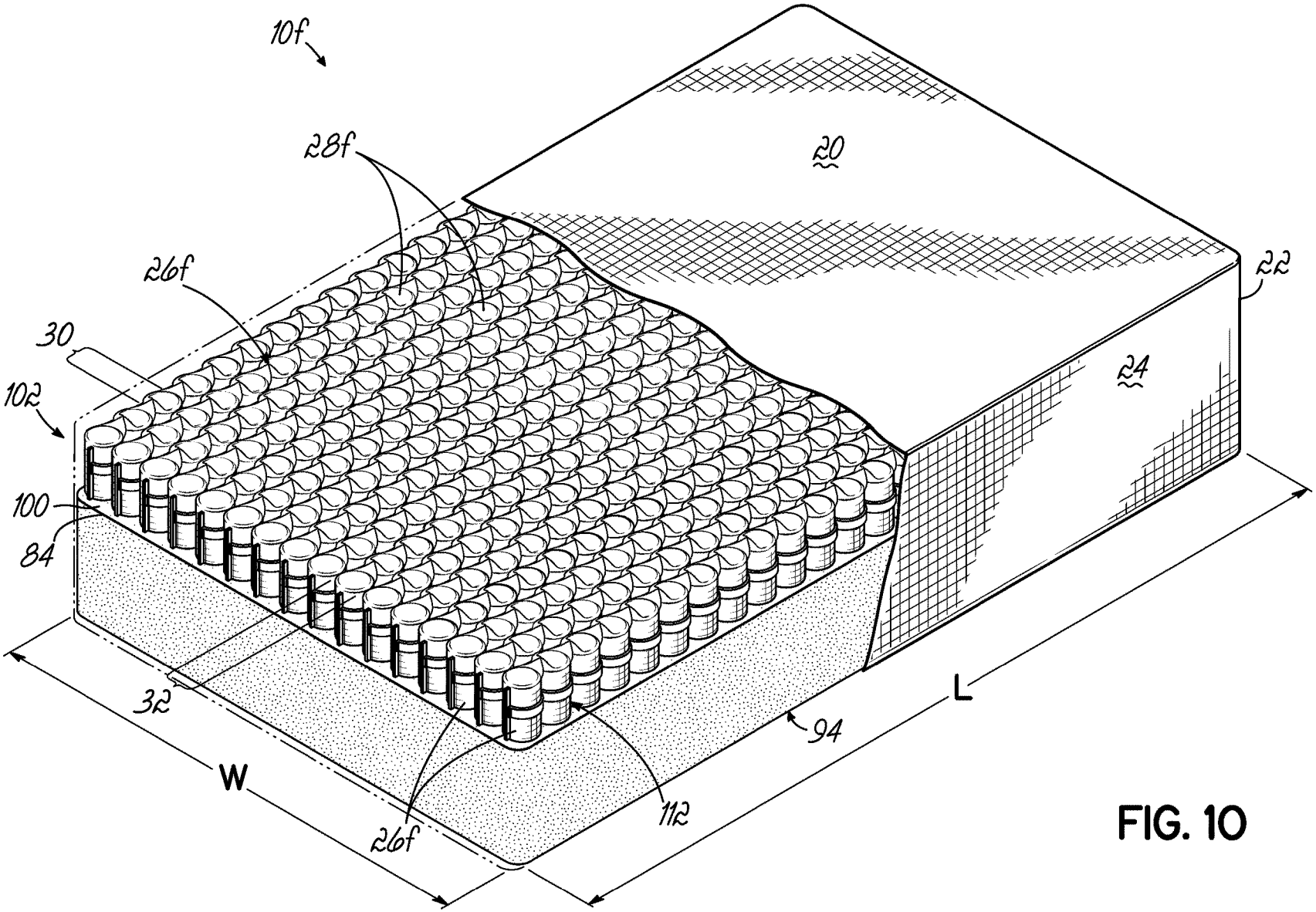
FIG. 10 is a perspective view, partially broken away, of another bedding product incorporating a foam core and having a topper comprising a mini pocketed buckling member assembly.
Figure 10A:
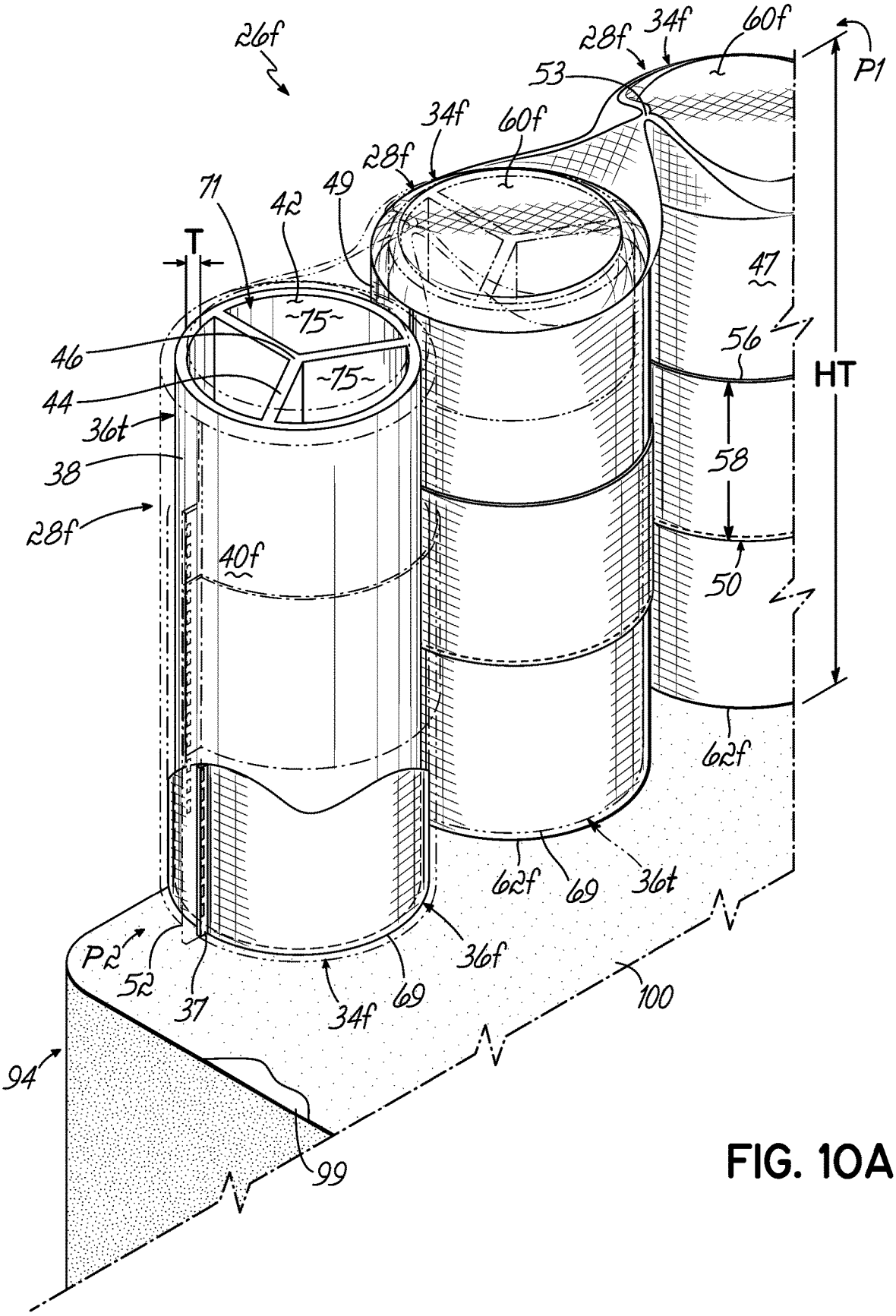
FIG. 10A is a perspective view, partially broken away, of a portion of one of the strings of the topper of FIG. 10.

FIGS. 10-10A illustrate an alternative embodiment of product such as a mattress 10*f* having a foam core 94 and a topper 112 residing on top of the foam core 94. The topper 112 comprises a mini pocketed buckling member assembly 102 which has a bottom scrim sheet 100 which may be glued or otherwise adhered to an upper surface 99 of the foam core 94. See FIG. 10A. The mini pocketed buckling member assembly 102 of topper 112 is illustrated comprising multiple strings 26*f* of pocketed buckling members 28*f* which are shorter than the strings 26 of the pocketed buckling members 28 described herein. As seen in FIG. 10, the strings 26*f* of pocketed buckling members 28*f* may be joined so that the individually pocketed buckling members 28*f* are aligned in transversely extending rows 30 and longitudinally extending columns 32. Alternatively, the strings 26*f* may be offset from one another, as shown in FIG. 6.

Although FIGS. 10-10A illustrate a foam core 94, the core on which the topper 112 resides may be any conventional core including a pocketed spring core, a pocketed buckling member core or combination of known elements.

The foam core 94 and a topper 112 residing above the foam core 94 are completely enclosed within an upholstered covering 20. As shown in FIG. 10, fully assembled, the mattress 10*f* has a length "L" defined as the linear distance between opposed end surfaces 22 (only one being shown in FIG. 10). Similarly, the assembled mattress 10*f* has a width "W" defined as the linear distance between opposed side surfaces 24 (only one being shown in FIG. 10). In the product shown in FIG. 10, the length is illustrated as being greater than the width. However, it is within the scope of the present invention that the length and width may be identical, as in a square product.

FIG. 10A illustrates a perspective view of the portion of a string 26*f* of pocketed buckling members 28*f* in a relaxed condition under no external load. As best illustrated in FIG. 10A, each string 26*f* of pocketed buckling members 28*f* comprises a row of interconnected fabric pockets 34*f*. Each of the fabric pockets 34*f* contains a single buckling member 36*t*. For simplicity, like numbers are used for like parts.

The string 26*f* has a generally planar top surface 60*f* in a top plane P1 and a parallel generally planar bottom surface 62*f* in a bottom plane P2. The linear distance between the top and bottom surfaces 60*f*, 62*f* of the string 26*f* defines a height "HT" of the string 26*f*. This linear distance further defines the height HT of the topper 112 because the strings 26*f* are approximately the same height. However, it is within the scope of the present invention that different strings of springs of the topper have different heights.

Although the topper 112 is shown comprising longitudinally extending strings 26*f* of individually pocketed buckling members 36*t*, the strings may extend transversely. Although the height HT of topper 112 is shown in the drawings to be a certain distance, the height HT of topper 112 may be any desired height but is preferably less than the height of the foam core 94.

Although FIGS. 10-10A illustrate buckling members 36*t* shaped like buckling members 36 but being a lesser height, the buckling members used in any topper shown or described herein may be any of the buckling members shown or described herein.

Figure 10B:
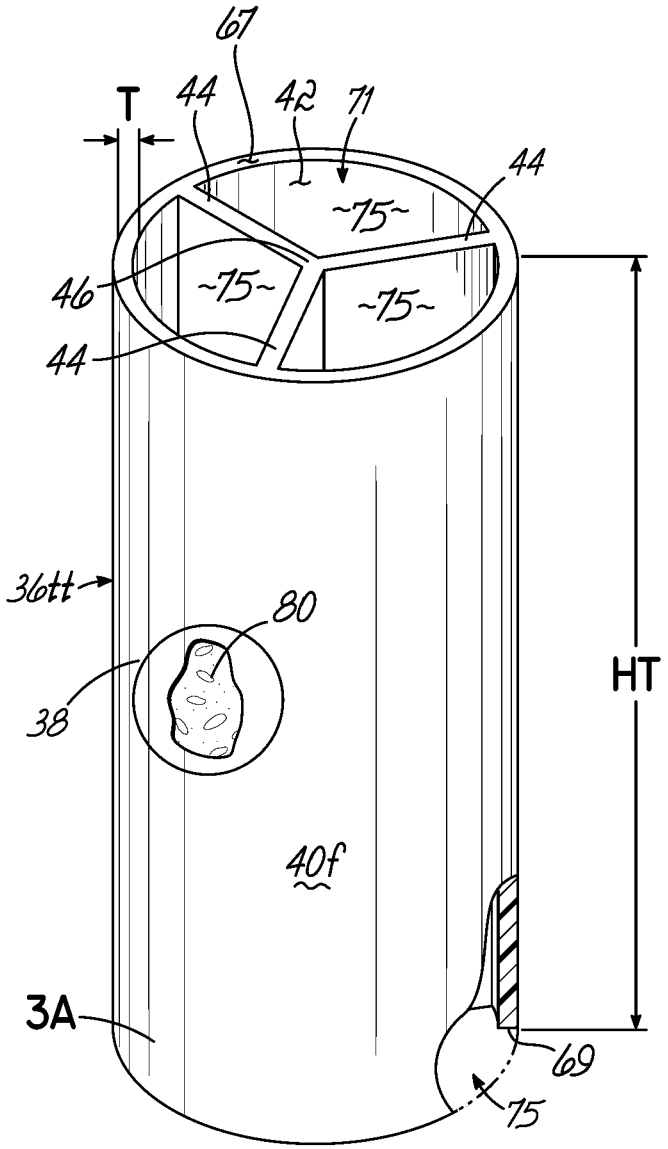
FIG. 10B is a perspective view of a buckling member used in the topper of FIG. 10 in a relaxed or unloaded condition.

FIG. 10B illustrates a buckling member 36*tt* shaped identical to buckling member 36*t* of FIGS. 10-10A and having the same height HT for use in a topper. However, buckling member 36*tt* has additives 80 mixed into the material used to make the buckling member 36*tt*. Regardless of the material used to make the buckling member 36*tt*, additives 80 such as slow-release fragrances, antimicrobial additives such as copper and silver, color additives, thermochromic materials, bed bug inhibitors, conductive additives such as graphite, aluminum powder, silicon carbide and diamond dust may be incorporated into the material. Density reducing agents such as fumed silica or gas generating materials may be added too.

If desired, buckling member 36*tt* with additives 80 may be used in place of any of the topper buckling members including buckling member 36*t* of FIGS. 10-10A.

Figure 11:
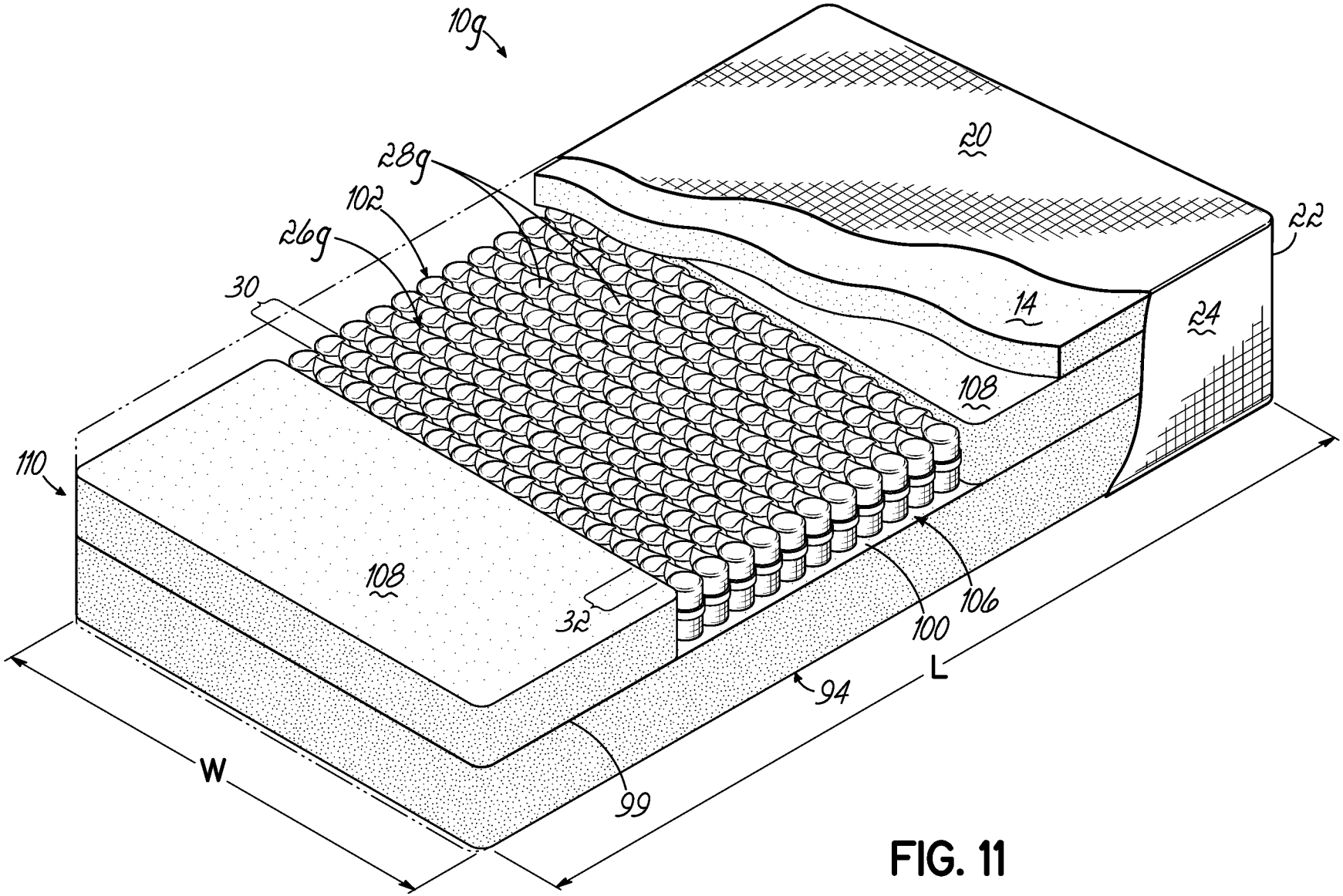
FIG. 11 is a perspective view, partially broken away, of a bedding product like FIG. 10 but having a posturized topper comprising a mini pocketed buckling member assembly.

FIG. 11 illustrates an alternative embodiment of product such as a mattress 10*g* having a foam core 94 and a topper 110 comprising a topper middle section 106 and two topper end sections 108. The topper 110 resides on top of the foam core 94. Each topper end section 108 comprises a piece of foam located adjacent to the topper middle section 106 and may be secured to the topper middle section 106 using adhesive or any known method. The foam pieces 108 may be glued or otherwise adhered to an upper surface 99 of the foam core 94. As shown in FIG. 11, a conventional padding or cushioning layer 14 resides above the topper 110.

The topper middle section 106 comprises a mini pocketed buckling member assembly 102 which has a bottom scrim sheet 100 which may be glued or otherwise adhered to an upper surface 99 of the foam core 94. The mini pocketed buckling member assembly 102 of topper 110 is illustrated comprising multiple strings 26*g* of pocketed buckling members 28*g* which are shorter than the strings 26 of the pocketed buckling members 28 described herein. The mini pocketed buckling member assembly 102 of topper 110 has longitudinally extending columns 32 and transversely extending rows 30 of pocketed buckling members. Alternatively, the strings 26*g* may be offset from one another, as shown in FIG. 6.

Although FIG. 11 illustrates a topper comprising three sections, the topper may comprise any number of sections, at least one of the sections comprising strings of pocketed buckling members. For example, the topper may have two sections oriented like "his" and "hers" sections. One of the topper sections may comprise strings of pocketed buckling members and the other topper section may comprise some other material.

Alternatively, in a topper being made solely of pocketed buckling members, some of the buckling members may have one or more additives as the term is defined herein while other buckling members have fewer or no additives. The different amount of additives may result in a posturized topper having different sections or areas of different firmness due to the different composition of the buckling members of the topper.

Referring to FIG. 11, the foam core 94, topper 110 and padding or cushioning layer 14 are completely enclosed within an upholstered covering 20. As shown in FIG. 10, fully assembled, the mattress 10*g* has a length "L" defined as the linear distance between opposed end surfaces 22 (only one being shown in FIG. 11). Similarly, the assembled mattress 10*g* has a width "W" defined as the linear distance between opposed side surfaces 24 (only one being shown in FIG. 11). In the product shown in FIG. 11, the length is illustrated as being greater than the width. However, it is within the scope of the present invention that the length and width may be identical, as in a square product.

Figure 12:
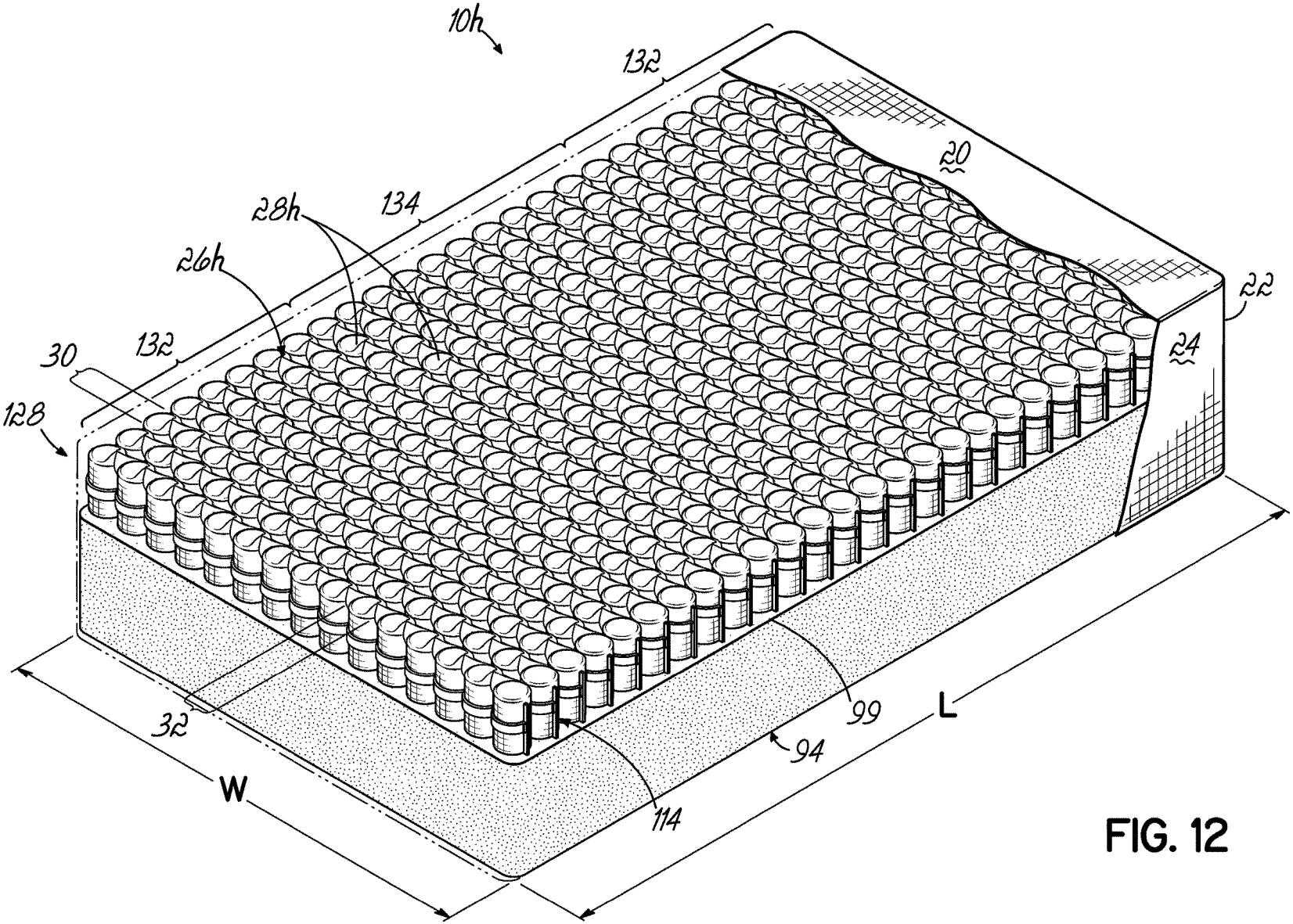
FIG. 12 is a cross-sectional view, partially broken away, of another bedding product incorporating a foam core and having a topper comprising a pocketed buckling member assembly and foam topper pieces.

FIG. 12 illustrates an alternative embodiment of product such as a mattress 10*h* having a foam core 94 and a posturized topper 114 comprising different areas or regions of different firmness due to the buckling members inside the pockets of the posturized topper 114. The posturized topper 114 resides on top of the foam core 94 and may be glued or otherwise adhered to an upper surface 99 of the foam core 94. Although not shown, one or more conventional padding or cushioning layers may reside above the topper 114. The posturized topper 114 comprises two end sections 132 and a middle section 134, such a posturized topper may have any number of sections.

The mini pocketed buckling member assembly 128 of topper 114 is illustrated in FIG. 12 comprising multiple strings 26*h* of pocketed buckling members 28*h* which are shorter than the strings 26 of the pocketed buckling members 28 described herein. As seen in FIG. 12, the strings 26*h* of pocketed buckling members 28*h* may be joined so that the individually pocketed buckling members 28*h* are aligned in transversely extending rows 30 and longitudinally extending columns 32. Alternatively, the strings 26*h* may be offset from one another, as shown in FIG. 6. Although the strings 26*h* are shown in FIG. 12 extending transversely or from side to side, they may be extend longitudinally.

Although FIGS. 11 and 12 illustrate a foam core 94 on which the toppers 110, 114 reside, respectively, the core may be any conventional core including a pocketed spring core, pocketed buckling member core or combination of known elements.

Figure 13:
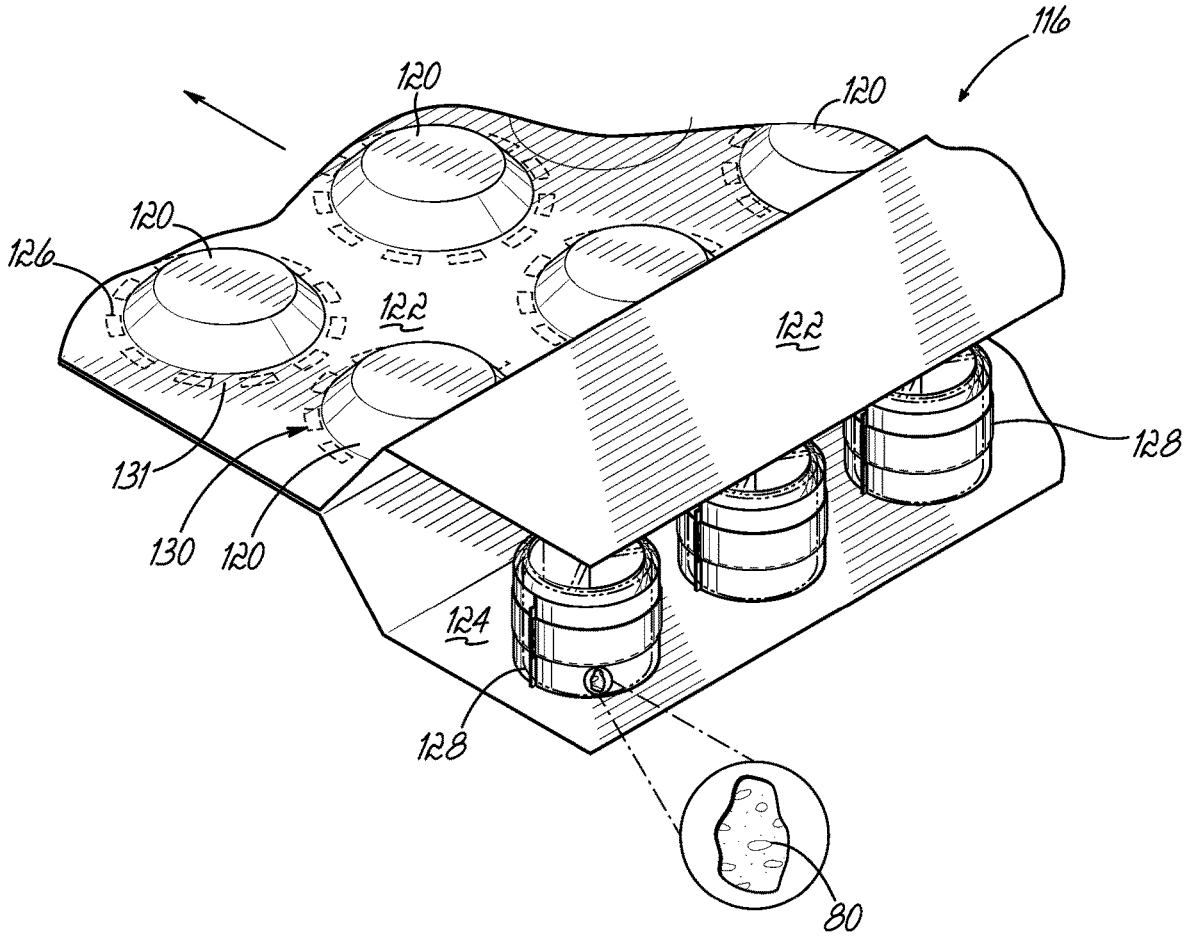
FIG. 13 is an enlarged perspective view of a portion of a comfort layer partially disassembled and a showing a portion of a welding tool.

FIG. 13 illustrates a pocketed comfort layer 116 made of two pieces of material, a first or upper ply 122 and a second or lower ply 124 which are welded together with circular weld seams 130. The circular weld seams 130 comprise arcuate weld segments 126 with gaps 131 therebetween. Instead of mini coil springs as disclosed in U.S. Pat. Nos. 9,943,173; 9,968,202 and 10,813,462, each patent of which is fully incorporated by reference, mini buckling members 128 are located inside pockets 120 defined by the circular weld seams 130.

The mini buckling members 128, like the other buckling members described herein, may be made of any material described herein and may have any additives described herein. Similarly, mini buckling members 128, like the other buckling members described herein, may be any desired shape or configuration described herein.

Figure 14:
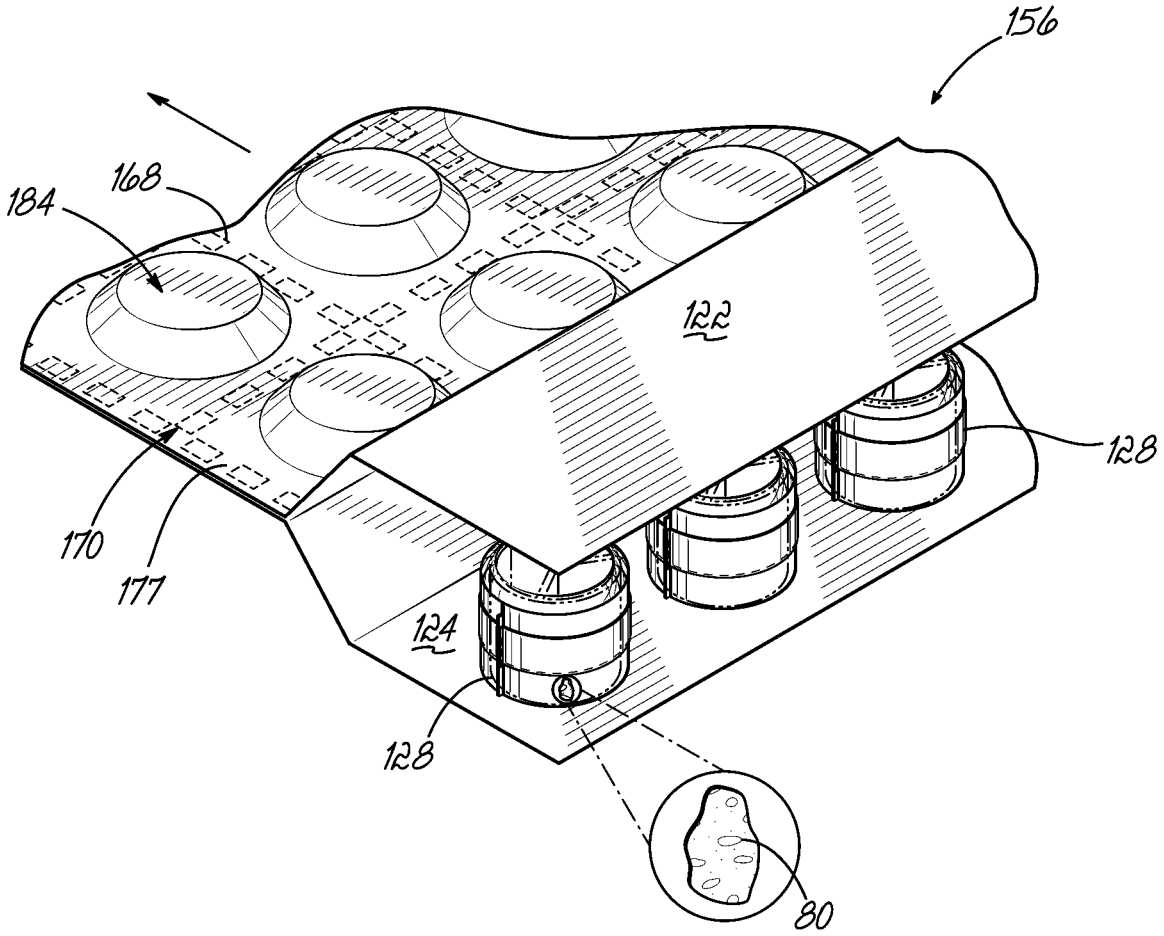
FIG. 14 is an enlarged perspective view of a portion of another comfort layer partially disassembled and a showing a portion of another welding tool.

FIG. 14 illustrates a pocketed comfort layer 156 made of two pieces of material, a first or upper ply 122 and a second or lower ply 124 which are welded together with intersecting linear weld seams 170. The linear weld seams 170 comprise straight weld segments 168 with gaps 177 therebetween. Instead of mini coil springs, mini buckling members 128 are located inside pockets 184 defined by the intersecting linear weld seams 170.

Each of the buckling members shown or described herein may be made by at least one of the following methods: extrusion and cut to a desired member height or injection molding.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed buckling member assembly comprising a plurality of parallel strings of pocketed buckling members, each of said strings being joined to at least one adjacent string, each of said strings comprising a piece of fabric surrounding a plurality of buckling members, first and second opposed plies of fabric being on opposite sides of the buckling members, a plurality of pockets having the same height formed along said string by a longitudinal seam and transverse seams joining said first and second plies, a single buckling member being in each pocket and having a height approximately equal to the height of the pocket, wherein each of the buckling members is a unitary member having an outer wall, internal ribs extending inwardly from the outer wall to a center, an open top and an open bottom defining passages between the internal ribs, each of the buckling members being made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

2. The product of claim 1 further comprising: cushioning materials; and a covering encasing said pocketed buckling member assembly and cushioning materials.

3. The product of claim 1, wherein at least some of the buckling members contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

4. The product of claim 1, wherein at least some of the buckling members have a different firmness than other buckling members.

5. The product of claim 4, wherein the pocketed buckling member assembly has a uniform height and the buckling member in each pocket has the same height as the pocketed buckling member assembly.

6. The product of claim 1, wherein at least some of the buckling members contain conductive additive solids, powders, particles or flakes.

7. The product of claim 1, wherein at least some of the buckling members have at least three internal ribs.

8. A pocketed buckling member assembly for a bedding or seating product, said pocketed buckling member assembly comprising:

a plurality of parallel strings of pocketed buckling members, each of the strings being joined to at least one adjacent string, each of said strings comprising a plurality of innerconnected pockets, each of the pockets containing one buckling member encased in fabric, the buckling member filling the pocket, the fabric being connected to itself along a longitudinal seam and having first and second opposed plies of fabric on opposite sides of the buckling members, a plurality of pockets formed along said string by transverse seams joining said first and second plies, wherein each of the buckling members is a unitary member being made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene, polypropylene and blends thereof.

9. The pocketed buckling member assembly of claim 8, wherein at least some of the buckling members contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

10. The pocketed buckling member assembly of claim 9, wherein at least some of the buckling members contain phase change materials.

11. The pocketed buckling member assembly of claim 8, wherein at least some of the buckling members contain conductive additive solids, powders, particles or flakes.

12. The pocketed buckling member assembly of claim 8, wherein at least some of the buckling members have an outer wall, internal ribs extending inwardly from the outer wall to a center, an open top and an open bottom defining passages between the internal ribs.

13. The pocketed buckling member assembly of claim 8, wherein the pocketed buckling member assembly has a uniform height and each buckling member in each pocket has the same height.

14. The pocketed buckling member assembly of claim 8, wherein at least some of the buckling members have an outer wall which is circular in cross-section.

15. A pocketed buckling member assembly for a bedding or seating product, said pocketed buckling member assembly comprising:

a plurality of parallel strings of pocketed buckling members, each of the strings being joined to an adjacent string, each of the strings comprising a plurality of interconnected pockets made from fabric, each of the pockets being approximately the same height, each pocket containing a single buckling member having the same height as the pocket, the piece of fabric being joined to itself along a longitudinal seam and having first and second opposed plies of fabric on opposite sides of the buckling members, the fabric of said first and second plies being joined by transverse seams; some of the strings having buckling members made of a different material than the buckling members of other strings, and wherein each of the buckling members is a unitary member having hollow passages and being made of one of the following: acrylic rubber, acrylonitrile butadiene rubber, butadiene rubber, butyl rubber, ethylene propylene diene monomer (EPDM) rubber, ethylene vinyl acetate (EVM) rubber, halogenated nitrile rubber, isoprene rubber, natural rubber, neoprene, polythiolethers, silicone rubber, styrene-butadiene, styrene copolymers, polystyrene, thermoplastic elastomers, vinyl methyl silicone, silicone, gel elastomer, polyurethane elastomer, polyurea elastomer, polyester, polyethylene and polypropylene.

16. The pocketed buckling member assembly of claim 15, wherein at least some of the buckling members contain at least one of the following additives: phase change materials, plant-based fibers, synthetic fibers, fragrances, slow-release fragrances, organic and inorganic antimicrobial additives, color additives, thermochromic materials, conductive additive solids, powders, particles, flakes, density reducing agents or gas generating materials.

17. The pocketed buckling member assembly of claim 15, wherein at least some of the buckling members have an outer wall, internal ribs extending inwardly from the outer wall to a center, an open top and an open bottom defining passages between the internal ribs.

18. The pocketed buckling member assembly of claim 15, wherein the buckling members are the same height.

19. The pocketed buckling member assembly of claim 15, wherein at least some of the buckling members contain conductive additive solids, powders, particles or flakes.

20. The pocketed buckling member assembly of claim 15, wherein at least some of the buckling members contain phase change materials.

* * * * *